US008917298B2

(12) United States Patent
Hasegawa

(10) Patent No.: US 8,917,298 B2
(45) Date of Patent: Dec. 23, 2014

(54) APPARATUS, METHOD AND COMPUTER PROGRAM PRODUCT FOR DRAWING IMAGE ON THERMAL MEDIUM

(75) Inventor: Fumihiro Hasegawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/988,423

(22) PCT Filed: Nov. 18, 2011

(86) PCT No.: PCT/JP2011/077272

§ 371 (c)(1),
(2), (4) Date: May 20, 2013

(87) PCT Pub. No.: WO2012/070665

PCT Pub. Date: May 31, 2012

(65) Prior Publication Data

US 2013/0242021 A1 Sep. 19, 2013

(30) Foreign Application Priority Data

Nov. 24, 2010 (JP) ..... 2010-261771
Mar. 3, 2011 (JP) ..... 2011-046861

(51) Int. Cl.
*B41J 2/325* (2006.01)
*B41J 2/32* (2006.01)
*B41J 2/475* (2006.01)

(52) U.S. Cl.
CPC . *B41J 2/32* (2013.01); *B41J 2/4753* (2013.01)
USPC ..... 347/171

(58) Field of Classification Search
USPC ..... 347/171, 183, 188, 190, 247
See application file for complete search history.

(56) References Cited

U.S. PATENT DOCUMENTS

| | | | |
|---|---|---|---|
| 6,835,942 | B2 | 12/2004 | Magoshi et al. |
| 7,039,487 | B2 | 5/2006 | Nagata et al. |
| 8,284,226 | B2 | 10/2012 | Hasegawa et al. |
| 2010/0039916 | A1 | 2/2010 | Hasegawa et al. |
| 2010/0289866 | A1 | 11/2010 | Hasegawa |
| 2011/0096040 | A1 | 4/2011 | Hasegawa |
| 2011/0235134 | A1 | 9/2011 | Hasegawa et al. |

FOREIGN PATENT DOCUMENTS

| | | |
|---|---|---|
| EP | 2251821 A2 | 11/2010 |
| JP | 2004-031836 | 1/2004 |
| JP | 2004-090026 | 3/2004 |
| JP | 2004-200351 | 7/2004 |
| JP | 2004-341373 | 12/2004 |
| JP | 2010-156950 | 7/2010 |
| JP | 2011-025647 | 2/2011 |

OTHER PUBLICATIONS

International Search Report Issued on Feb. 14, 2012 in PCT/JP2011/077272 filed on Nov. 18, 2011.

*Primary Examiner* — Kristal Feggins
(74) *Attorney, Agent, or Firm* — Oblon, Spivak, McClelland, Maier & Neustadt, L.L.P.

(57) ABSTRACT

An apparatus for drawing an image on a thermal medium includes a stroke group generating unit configured to group continuous strokes forming the image of a desired character to be drawn to generate one or more stroke groups of the continuous strokes, a first overlapped part removing unit configured to detect a first overlapped part between a first combination of the strokes associated with the same stroke group to remove the first overlapped part in an arranged order of the strokes within the same stroke group, and a second overlapped part removing unit configured to detect a second overlapped part between a second combination of the strokes associated with plural of the stroke groups to remove the second overlapped part from the stroke groups.

9 Claims, 43 Drawing Sheets

FIG.7

| PARAMETER |
| --- |
| CHARACTER TYPE |
| CHARACTER STRING (CHARACTER ENCODING STRING) |
| BOLD-FACED CHARACTER (NUMBER OF PARALLEL STROKES, OVERLAPPED WIDTH) |
| CHARACTER SIZE (WIDTH, HEIGHT) |
| CHARACTER SPACING |
| LINE SPACING |
| LINE DRAWING DIRECTION |
| DRAWING RANGE |
| ACCEPTABLE DRAWING RANGE |
| ROTATION |
| ⋮ |

| | | |
|---|---|---|
| c | 8250 | |
| m | 24 | 24 |
| d | 88 | 24 |
| m | 56 | 24 |
| d | 56 | 224 |
| d | 24 | 176 |

```
c 8263
m  24  24
d  24 224
d 124 224
b 340 124 124  24
d  24  24
m  48  48
d  48 200
d 124 200
b 260 124 124  48
d 48   48
```

FIG.12A

STROKE GROUP MANAGEMENT DATA

| | | |
|---|---|---|
| | GN 26 | ←STROKE GROUP SERIAL NUMBER |
| | NM 3 | ←TOTAL NUMBER OF ASSOCIATED STROKES |
| STROKE #1 | SN 987 | ←STROKE NUMBER OF STROKE #1 (OVERALL SERIAL NUMBER) |
| | XS 24 | ←X-COORDINATE OF START POINT OF STROKE #1 |
| | YS 24 | ←Y-COORDINATE OF START POINT OF STROKE #1 |
| | XE 48 | ←X-COORDINATE OF END POINT OF STROKE #1 |
| | YE 24 | ←Y-COORDINATE OF END POINT OF STROKE #1 |
| STROKE #2 | SN 78 | ←STROKE NUMBER OF STROKE #2 |
| | XS 48 | ←X-COORDINATE OF START POINT OF STROKE #2 |
| | YS 24 | ←Y-COORDINATE OF START POINT OF STROKE #2 |
| | XE 72 | ←X-COORDINATE OF END POINT OF STROKE #2 |
| | YE 48 | ←Y-COORDINATE OF END POINT OF STROKE #2 |
| STROKE #3 | SN 8 | ←STROKE NUMBER OF STROKE #3 |
| | XS 72 | ←X-COORDINATE OF START POINT OF STROKE #3 |
| | YS 48 | ←Y-COORDINATE OF START POINT OF STROKE #3 |
| | XE 72 | ←X-COORDINATE OF END POINT OF STROKE #3 |
| | YE 72 | ←Y-COORDINATE OF END POINT OF STROKE #3 |

DISTANCE BETWEEN END POINTS = STROKE WIDTH

APPARATUS, METHOD AND COMPUTER PROGRAM PRODUCT FOR DRAWING IMAGE ON THERMAL MEDIUM

TECHNICAL FIELD

The disclosures herein generally relate to a thermal technology for drawing an image by the application of a laser beam onto a thermal medium having a property of developing colors with heat.

BACKGROUND ART

Rewritable technologies are becoming popular in view of their convenience and reduction in environmental burden, and various models of the rewritable technologies have been put forward. Among these rewritable models, thermal rewritable media (TRM) utilizing heat have quickly been released as commercial products and put on the market.

The related art thermal rewritable technologies generally employ a heating recording system in which thermal rewritable media are recorded on by heating with a thermal head; however, recent thermal rewritable technologies suggest that the thermal rewritable media may be heated by the application of a laser beam, as disclosed, for example, in Japanese Patent Application Publication No. 2004-90026 (hereinafter referred to as "Patent Document 1"). Such a thermal rewritable technology utilizing heat of the laser beam largely differs from the thermal rewritable technology utilizing heat of the thermal head in that the thermal rewritable technology utilizing heat of the laser beam involves contactless heating with the laser beam. In this configuration, since the laser beam is applied to the media from a distance, it may be possible to make records on movable media, such as containers being carried on a conveyor belt, by the application of a laser beam. Thus, the thermal rewritable technology utilizing the laser beam may expand its application range. Note that the recording or formation of images by the laser beam is a technology well-known in the art, which is disclosed, for example, in Japanese Patent Application Publication No. 2004-341373 (hereinafter referred to as "Patent Document 2").

The thermal rewritable media have properties of dissipating their colors at certain temperatures and developing their colors by being heated at temperatures higher than the dissipating temperatures. However, when excessive heat is applied to the thermal rewritable media, their properties may be altered, thereby exhibiting deterioration such as a decrease in their life span or incomplete erasure of the recordings.

For example, when the laser beam having a predetermined stroke width (a stroke of a laser beam) is repeatedly applied to a same area of a thermal rewritable medium, the excessive heat may be applied to that area of the thermal rewritable medium due to the overlapped laser beam application. Examples of such an area include an "intersection", a "turnaround" and an "approach" of the strokes (line component illustrating traces of the laser beam applied while traveling).

FIGS. 1 and 2 are diagrams illustrating examples of characters recorded by a laser beam on the thermal rewritable medium.

FIG. 1 illustrates a deformed numeral "7" (a diagonal line is added to "7") that includes an overlapped part P1 formed of the intersection of the strokes. The overlapped part P1 of the strokes is formed by repeatedly applying the laser beam onto a part of the stroke still having residual heat that has just been formed on the thermal rewritable medium with the laser beam. As a result, the strokes on the thermal rewritable medium acquire the overlapped part P1 having a higher temperature, which may adversely affect the thermal rewritable medium.

Further, the strokes in FIG. 1 include an overlapped part P2 formed of the turnaround of the strokes. Since the turnaround of the strokes on the rewritable medium is formed by applying the laser beam for a relatively longer time due to the effect of the mirror inertia that controls an emission direction of the laser beam, the turnaround of the strokes (i.e., the overlapped part P2) on the thermal rewritable medium obtains a higher temperature, which may adversely affect the thermal rewritable medium.

FIG. 2 illustrates an example of a "radical" that is a component of kanji characters that is used to classify each kanji systematically. Note that the radical in this example appears on the left side of the kanji and indicates the meaning of "Man". In this example, the strokes in FIG. 2 include no actually overlapped part formed by the traces of the center of the laser beam; however, an overlapped part P3 of the strokes in FIG. 2 is obtained due to the width of the laser beam.

In the thermal rewritable technology utilizing the laser beam disclosed in Patent Document 2, attempts have been made to eliminate the overlaps of the strokes by dividing, dissipating or shortening the strokes and reducing the lengths of the strokes in order to prevent the adverse effect on the thermal rewritable media. For example, if two strokes have an overlapped part, the overlapped part is eliminated by dividing, dissipating or shortening one of the strokes having an amount to be removed smaller than that of the other one. If the two strokes have the same amounts to be removed, one of the strokes subject to dividing, dissipating or shortening may be determined based on the drawing order of the strokes to be drawn (preceding or subsequent stroke to be drawn).

When the overlapped part including a stroke width is eliminated in the above manner, mutually approaching two or more strokes may be disconnected or fragmented, which may result in degradation of drawing quality.

FIG. 3A illustrates strokes forming a character "x" drawn in a cursive style before eliminating an overlapped part. The cursive character "x" in FIG. 3A is formed of continuously drawn strokes ST1 to ST7 and continuously drawn strokes ST8 to ST14.

In this case, if an overlapped part is eliminated from the cursive character "x" formed of the two groups (sets) of continuous strokes illustrated in FIG. 3A, the cursive character "x" may result in disconnected fragmented strokes illustrated in FIG. 3B. That is, each of the strokes ST3, ST6, ST9 and ST12 (FIG. 3A) has one end shortened, resulting in strokes ST3', ST6', ST9' and ST12' (FIG. 3B). The strokes ST4 and ST11 (FIG. 3A) are dissipated, and each of the strokes ST10 and ST5 (FIG. 3A) has both ends shortened, resulting in strokes ST10' and ST5' (FIG. 3B).

Such degradation of drawing quality due to the disconnection or fragmentation of the strokes may be observed not only in the continuously drawn strokes but also in an "intersection" of a continuously drawn character "a" or a "loop" part of a character "su" of hiragana in Japanese.

SUMMARY OF THE INVENTION

It is a general object of embodiments of the present invention to provide an apparatus, a method and a computer readable medium storing a program for drawing an image on a thermal medium without degradation of image quality due to disconnection of two or more proximate strokes that substantially eliminate one or more problems caused by the limitations and disadvantages of the related art.

In one embodiment, there is provided an apparatus for drawing an image on a thermal medium. The apparatus includes a stroke group generating unit configured to group continuous strokes forming the image of a desired character to be drawn to generate one or more stroke groups of the continuous strokes; a first overlapped part removing unit configured to detect a first overlapped part between a first combination of the strokes associated with a same stroke group to remove the first overlapped part in an arranged order of the strokes within the same stroke group; and a second overlapped part removing unit configured to detect a second overlapped part between a second combination of the strokes associated with plural of the stroke groups to remove the second overlapped part from the stroke groups.

In another embodiment, there is provided a method for drawing an image on a thermal medium. The method includes grouping continuous strokes forming the image of a desired character to be drawn to generate one or more stroke groups of the continuous strokes; detecting a first overlapped part between a first combination of the strokes associated with a same stroke group to remove the first overlapped part in an arranged order of the strokes within the same stroke group; and detecting a second overlapped part between a second combination of the strokes associated with plural of the stroke groups to remove the second overlapped part from the stroke groups.

In another embodiment, there is provided a non-transitory computer-readable recording medium embodying a drawing control program for drawing an image on a thermal medium, which, when processed by a processor, causes a drawing control unit of a drawing apparatus to execute a set of instructions of the drawing control program. The set of instructions includes grouping continuous strokes forming the image of a desired character to be drawn to generate one or more stroke groups of the continuous strokes; detecting a first overlapped part between a first combination of the strokes associated with a same stroke group to remove the first overlapped part in an arranged order of the strokes within the same stroke group; and detecting a second overlapped part between a second combination of the strokes associated with plural of the stroke groups to remove the second overlapped part from the stroke groups.

BRIEF DESCRIPTION OF THE DRAWINGS

Other objects and further features of embodiments will be apparent from the following detailed description when read in conjunction with the accompanying drawings, in which:

FIG. 7 is a diagram illustrating an example of a data structure of parameters specified by a user;

FIGS. 12A and 12B are diagrams illustrating a structural example of stroke group management data;

FIG. 14 is a diagram illustrating a structural example of flag data or the like;

BEST MODE OF CARRYING OUT THE INVENTION

In the following, preferred embodiments will be described with reference to the accompanying drawings.

[Configuration]

Figure 5:
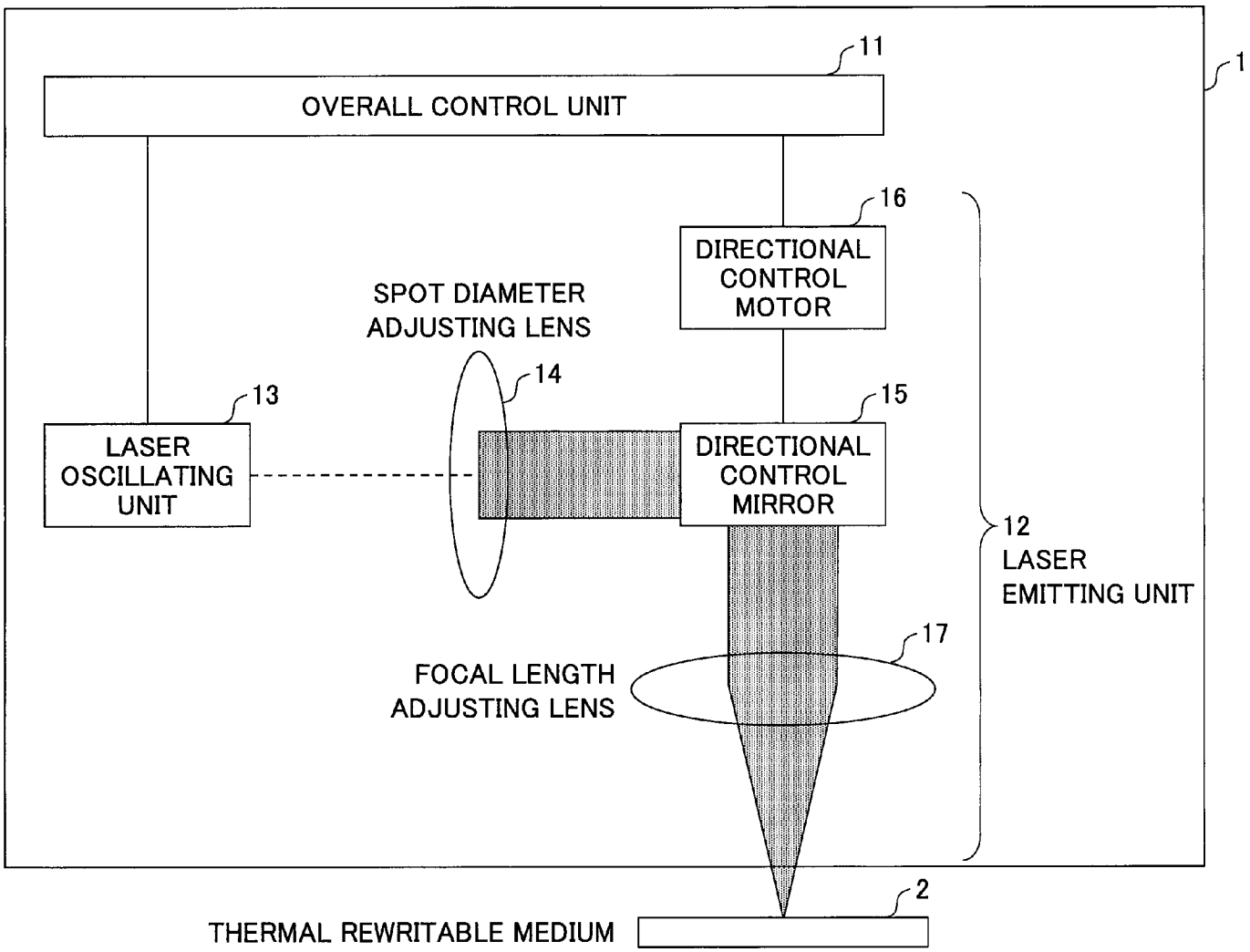
FIG. 5 is a diagram illustrating a configuration example of a thermal rewritable medium drawing apparatus according to an embodiment.

FIG. 5 is a diagram illustrating a configuration example of a thermal rewritable medium drawing apparatus 1 according to an embodiment.

In FIG. 5, the thermal rewritable medium drawing apparatus 1 includes an overall control unit 11 configured to control overall operations of the thermal rewritable medium drawing apparatus 1 and a laser emitting unit 12 configured to emit a laser beam. Further, the laser emitting unit 12 includes a laser oscillator 13, a spot diameter adjusting lens 14 configured to adjust a spot diameter of the laser beam (i.e., to enlarge the spot diameter), a directional control mirror 15 configured to change an emitting direction of the laser beam, a directional control motor 16 configured to drive the directional control mirror 15 and a focal length adjusting lens 17 configured to converge the laser beam redirected by the directional control mirror 15 on the thermal rewritable medium 2.

A semiconductor laser diode (LD) is generally utilized as the laser oscillator 13; however, a gas laser oscillator, a solid-state laser oscillator, a liquid laser oscillator, and the like may also be utilized. The directional control motor 16 may be a servomotor configured to control a reflection surface of the directional control mirror 15 in two axial directions. The directional control motor 16 and the directional control mirror 15 form a galvanometer mirror.

The thermal rewritable medium 2 may be formed of a film having separated leuco dye and developer. The thermal rewritable medium 2 having such a configuration may develop color when the thermal rewritable medium 2 is rapidly cooled at a predetermined temperature Ta such that the leuco dye and the developer are bonded, and dissipate the color when the thermal rewritable medium 2 is cooled at a predetermined temperature Tb lower than the predetermined temperature Ta such that the leuco dye and the developer are separated again. The thermal rewritable medium 2 may be rewritable thermosensitive recording paper. In the thermal rewritable medium drawing apparatus 1 according to the embodiment, deterioration of such a thermal rewritable medium 2 may be controlled; however, deterioration of non-rewritable media may also be controlled.

Figure 6:
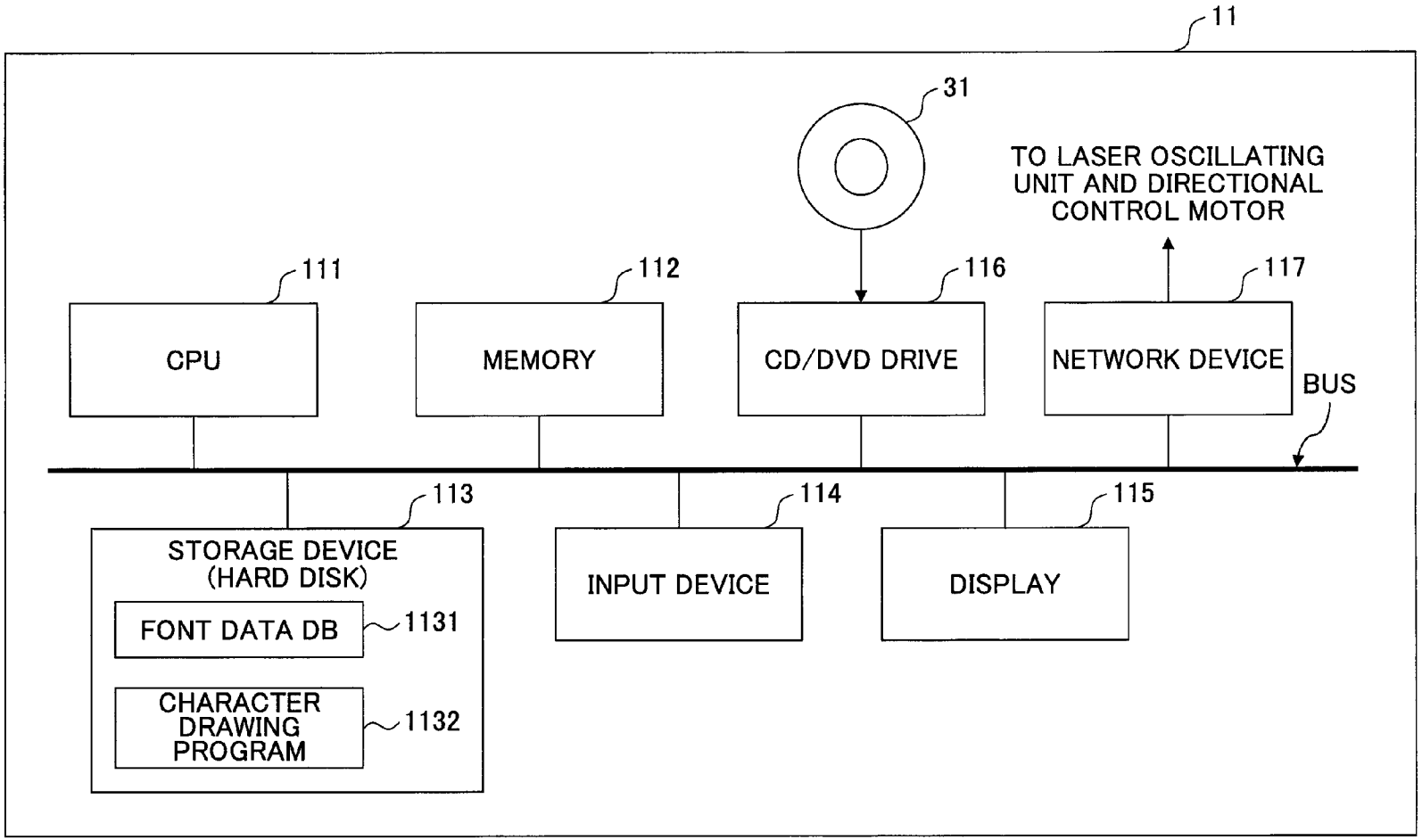
FIG. 6 is a diagram illustrating a configuration example of an overall control unit of the thermal rewritable medium drawing apparatus according to the embodiment.

FIG. 6 is a diagram illustrating a configuration example of the overall control unit 11. Specifically, FIG. 6 illustrates a hardware configuration of the overall control unit 11 in a case where the overall control unit 11 is mainly implemented by software. Accordingly, a computer in this case is a physical entity. In a case where a computer is not physical entity for the overall unit 11, the overall control unit 11 is implemented by an IC made for a specific function such as an ASIC (Application Specific Integrated Circuit).

The overall control unit 11 includes a CPU 111, a memory 112, a storage device 113, an input device 114, a display 115, a CD/DVD drive 116 and a network device 117. The storage device 113 such as a hard disk drive (HDD) includes a font data DB 1131 that stores font data including stroke fonts and outline fonts for a series of characters and a character drawing program 1132 that generates a drawing instruction for drawing characters by eliminating an overlapped part from the font data and controls the laser emitting unit 12 (see FIG. 5).

The CPU 111 retrieves the character drawing program 1132 from the storage device 113 to execute the character drawing program 1132, such that a character is drawn on the thermal rewritable medium 2 based on the later described procedure. Note that the memory 112 may be a volatile memory such as a DRAM utilized as a work area while the character drawing program 1132 is being executed by the CPU 111. The input device 114 may be a mouse or a keyboard utilized by a user to input instructions for controlling the laser emitting unit 12. The display 115 is utilized as a user interface that displays a GUI (Graphical User Interface) with a predetermined number of colors at a predetermined resolution based on screen information provided by the character drawing program 1132. For example, the display 115 displays an entry field for the user to input a character that the user desires to draw on the thermal rewritable medium 2.

The CD/DVD drive 116 is structurally configured to hold or eject a CD/DVD 31. When the CD/DVD drive 116 is configured to retrieve data from the CD/DVD 31 or write data on the CD/DVD 31 while the CD/DVD drive 116 holds the CD/DVD 31, the font data DB 1131 and the character drawing program 1132 are stored in the CD/DVD 31 ready for delivery. Thus, the font data DB 1131 and the character drawing program 1132 are retrieved from the CD/DVD 31 and the retrieved character drawing program 1132 is installed in the storage device 113. The CD/DVD 31 may be any one of nonvolatile memories such as a Blu-ray disc (registered trademark), an SD card, a memory stick (registered trademark), a multimedia card, and an xD card.

The network device 117 serves as an interface (e.g., Ethernet (registered trademark) card) for connecting to a LAN or the Internet. The network device 117 is capable of executing processes according to protocols specified in a Physical Layer or a Data Link Layer of the OSI Reference Model, and transmitting the drawing instructions to the laser emitting unit 12 based on character encoding. The font data 1131 and the character drawing program 1132 may be downloaded from predetermined servers connected via the network. Alternatively, the overall control device 11 and the laser emitting unit 12 may have a direct physical connection via a USB (Universal Serial Bus), IEEE 1394, wireless USB, or Bluetooth without being connected via the network.

A target character desired to be drawn on the rewritable medium 2 may be stored as a list in the storage device 113, or may be input via the input device 114. The target character is specified by character encoding system such as UNICODE or JIScode. The overall control unit 11 retrieves character font data for the target character corresponding to the specified character code from the font data DB, converts the retrieved character font data for the target character into a set of drawing instructions, and executes the set of drawing instructions to control the laser emitting unit 12.

FIGS. 7 to 14 are examples of data processed by the overall control unit 11 of the thermal rewritable medium drawing apparatus 1.

FIG. 7 is a diagram illustrating an example of a data structure of parameters specified by a user. The data structure of parameters is composed of items including "character type", "character string (a character code array)", "boldface (the number of parallel strokes, overlapped width)", "character spacing", "line spacing", "line progression direction", "drawing range", "allowable drawing range" and "rotation".

Figure 8:
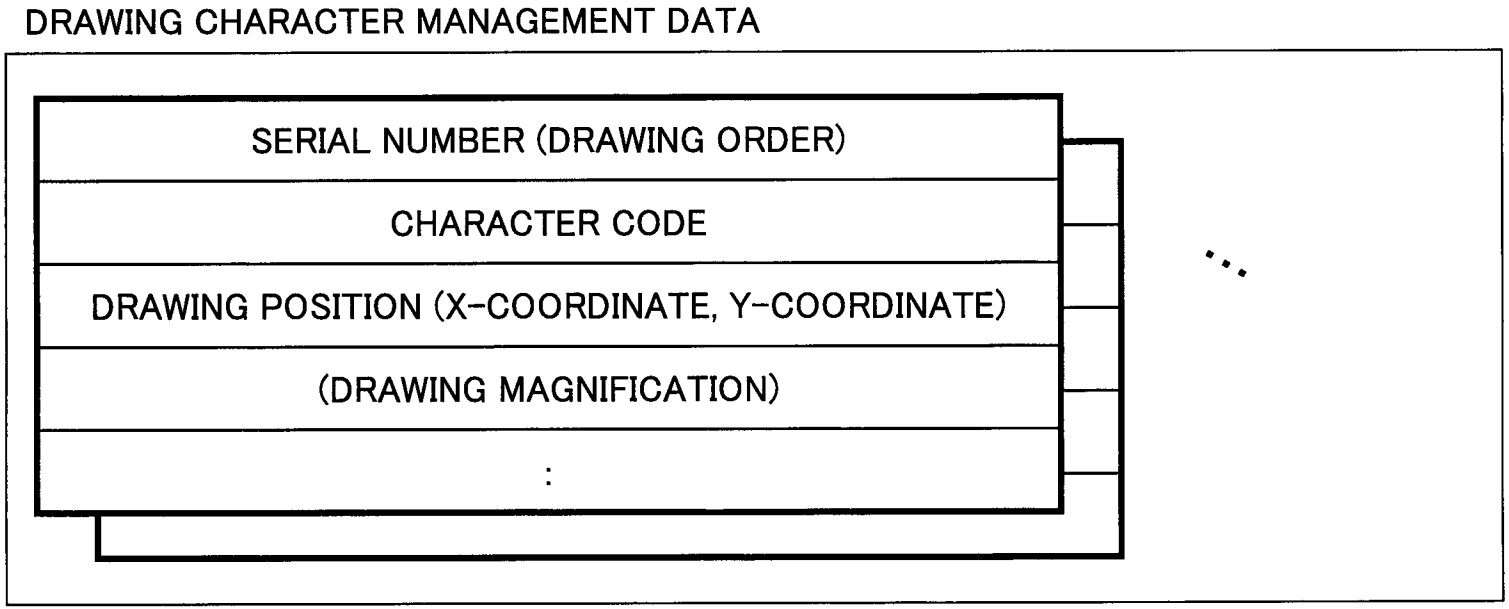
FIG. 8 is a diagram illustrating a structural example of drawing character management data.

FIG. 8 is a diagram illustrating an example of a data structure of drawing character management data. The data structure of the drawing character management data is composed of items including "serial number (drawing order)", "character code", "drawing position (X-coordinate, Y-coordinate)", and "drawing magnification".

Figure 9:
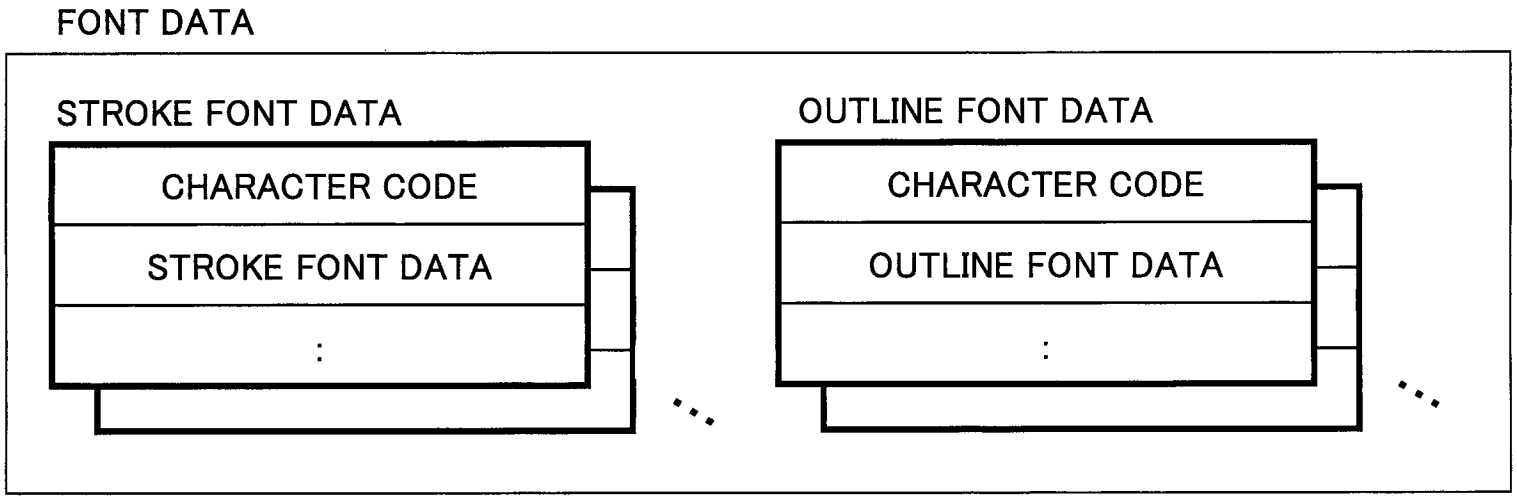
FIG. 9 is a diagram illustrating a structural example of font data.

FIG. 9 is a diagram illustrating an example of a data structure of font data. The data structure of font data includes stroke font data and outlined font data. The stroke font data include characters formed of central line traces or single strokes and the outlined font data include characters formed of outlined traces or hollow outlines. Every character stored in the stroke font data includes the "character code" that is associated with the "stroke font data". Likewise, every character stored in the stroke font data includes the "character code" that is associated with the "outlined font data".

Figures 10A, 10B:
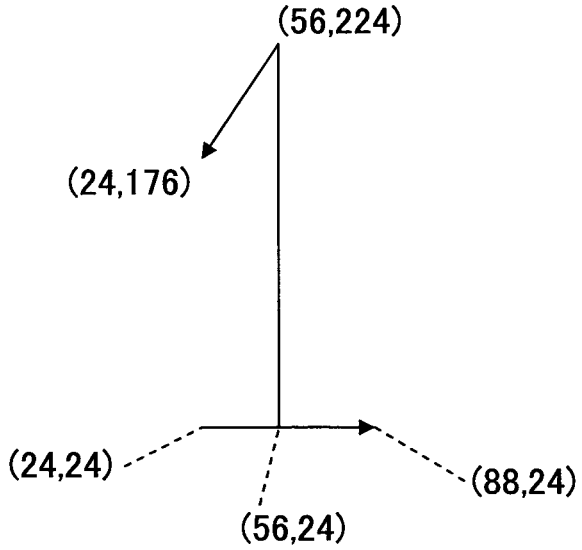
FIGS. 10A and 10B are diagrams illustrating a structural example of stroke font data.

FIG. 10A is a diagram illustrating an example of a data structure of the stroke font data. The stroke font data include a list composed of a line starting with "c" representing the "character code", a line starting with "m" representing "data migration", a line starting with "d" representing a straight line drawing, and a line starting with b (not illustrated in this example) representing a curved line drawing. FIG. 10B illustrates a character corresponding to the stroke font data illustrated in FIG. 10A.

Figures 11A, 11B:
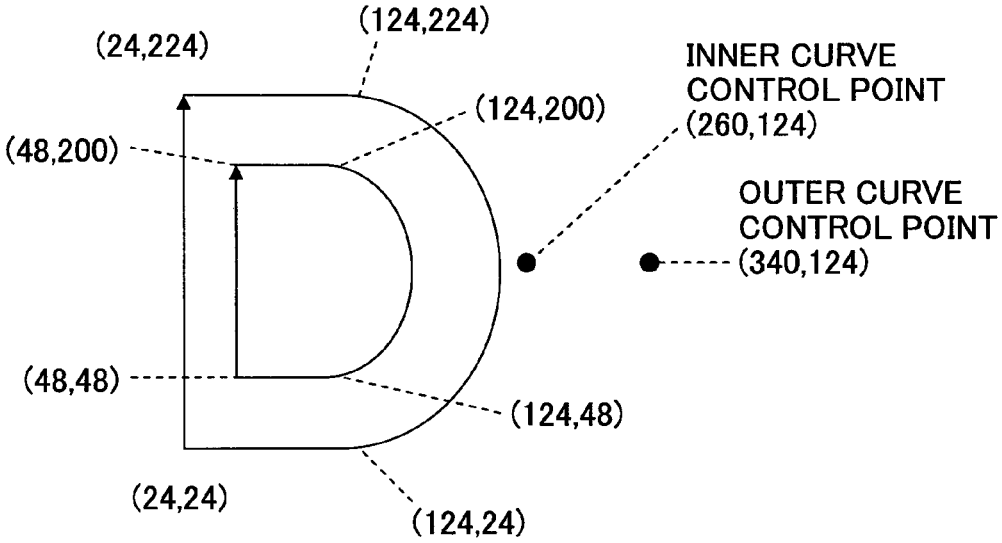
FIGS. 11A and 11B are diagrams illustrating a structural example of outline font data.

FIG. 11A is a diagram illustrating an example of a data structure of the outlined font data. The outlined font data include a list composed of a line starting with "c" representing the "character code", a line starting with "m" representing "data migration", a line starting with "d" representing a straight line drawing, and a line starting with b representing a curved line drawing. FIG. 11B illustrates a character corresponding to the outlined font data illustrated in FIG. 11A.

Figure 12B:
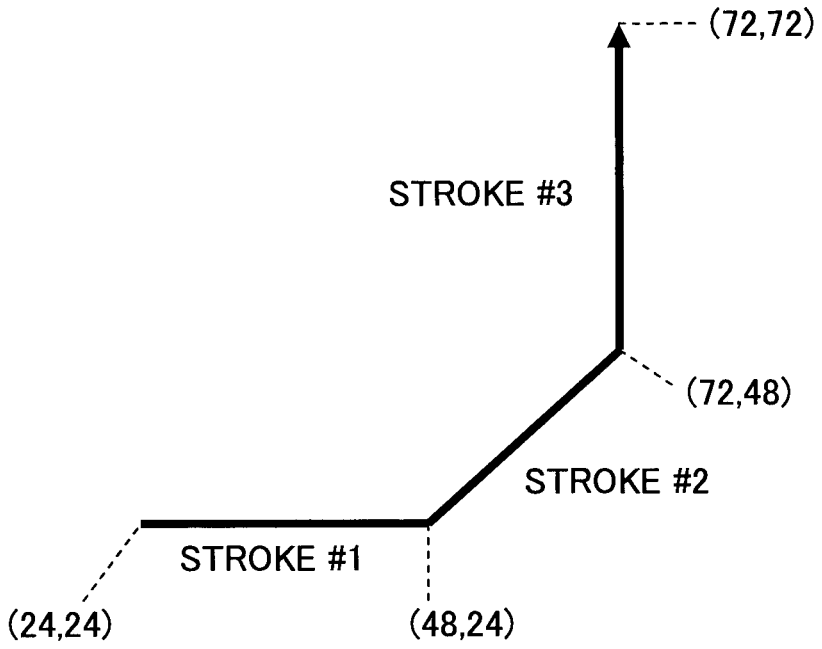

FIG. 12A is a diagram illustrating an example of a data structure of stroke group management data. The stroke group management data include a list composed of a line starting with "GN" representing a "serial number of the stroke group", a line starting with "NM" representing a "total number of strokes associated with the stroke group", and data associated with the stroke group. The data of each stroke include a line starting with "SN" representing a stroke number, a line starting with "XS" representing a starting point of an X coordinate, a line starting with "YS" representing a starting point of a Y coordinate, a line starting with "XE" representing an end point of the X coordinate, and a line starting with "YE" representing an end point of the Y coordinate. FIG. 12B illustrates an example of a stroke group corresponding to the stroke group management data illustrated in FIG. 12A.

Figure 13:
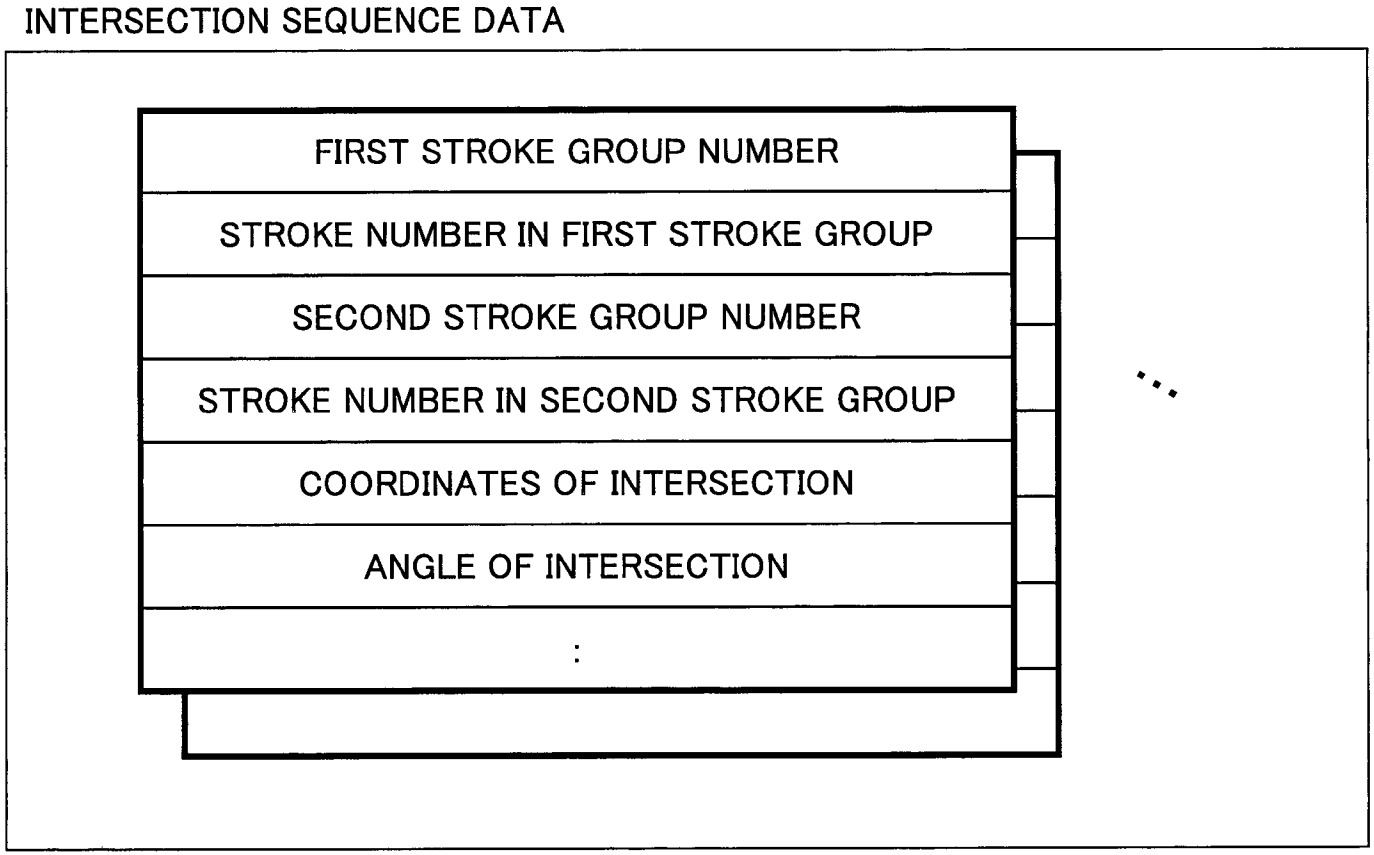
FIG. 13 is a diagram illustrating a structural example of intersection sequence data.

FIG. 13 is a diagram illustrating an example of a data structure of intersection sequence data associated with respective stroke groups. The data structure of the intersection sequence data for each intersection is composed of items including "a first stroke group number", "a stroke number in the first stroke group", "a second stroke group number", "a stroke number in the second stroke group", "coordinates of the intersection", and "an angle of intersection".

Figure 14:
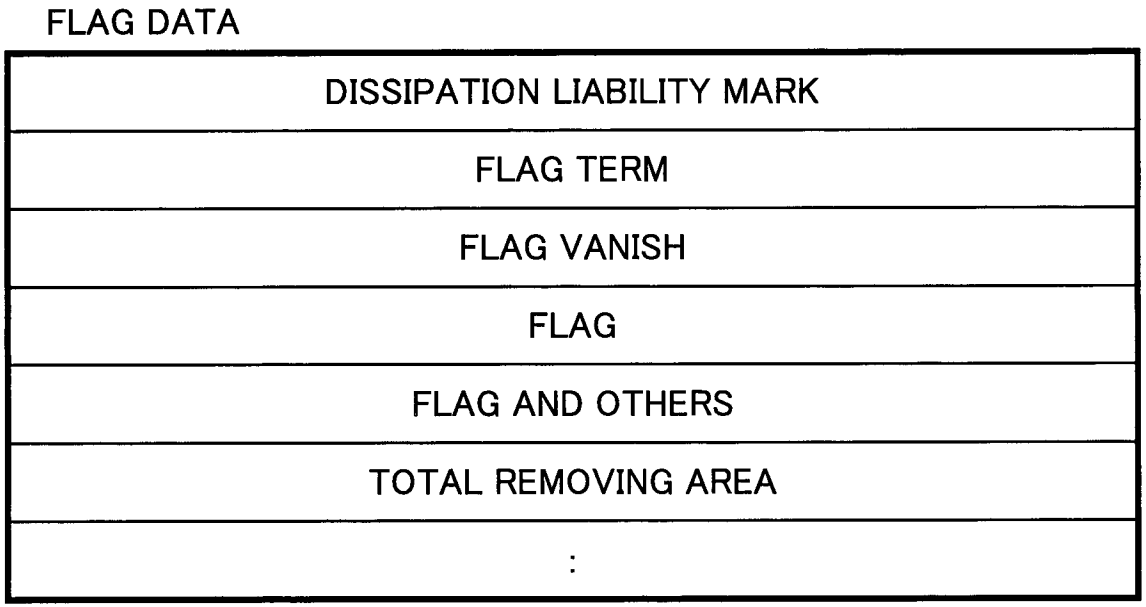

FIG. 14 is a diagram illustrating an example of a data structure of flag and other data. The data structure of the flag and other data is composed of items including "a dissipation liability mark", "a flag term", "a flag vanish", "a flag", "a flag and others" and "a total removing area".

[Operation]

Figure 15:
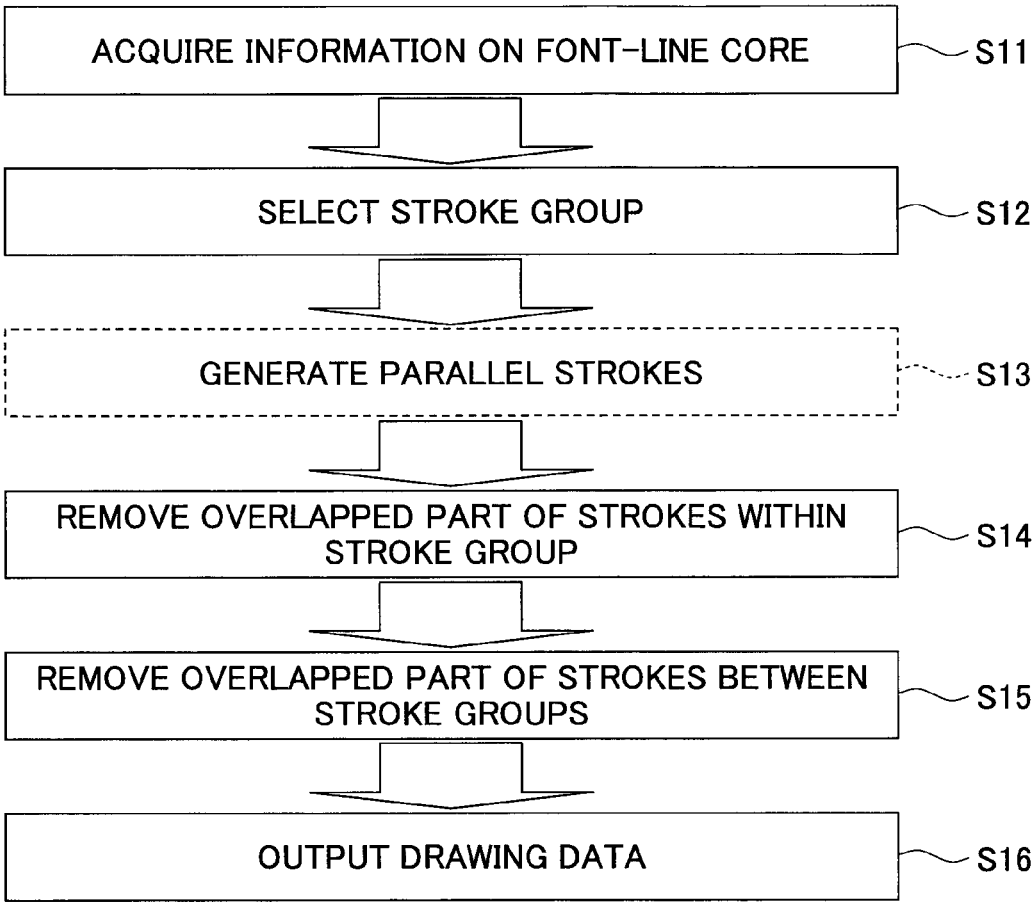
FIG. 15 is a flowchart illustrating an outline of a process carried out by the thermal rewritable medium drawing apparatus according to the embodiment.
Figure 16A:
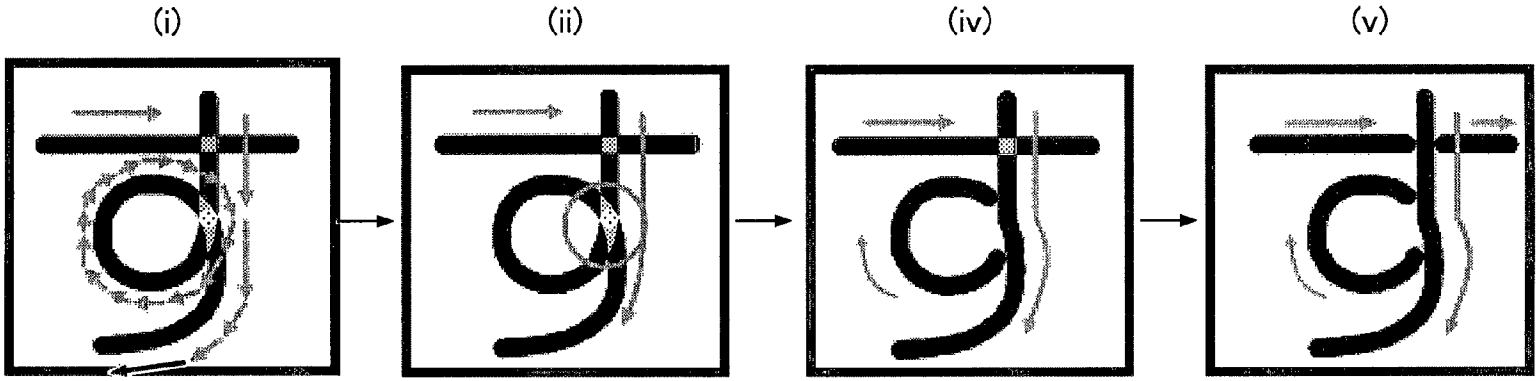
FIGS. 16A and 16B are diagrams illustrating examples of the process carried out by the thermal rewritable medium drawing apparatus according to the embodiment.
Figure 16B:
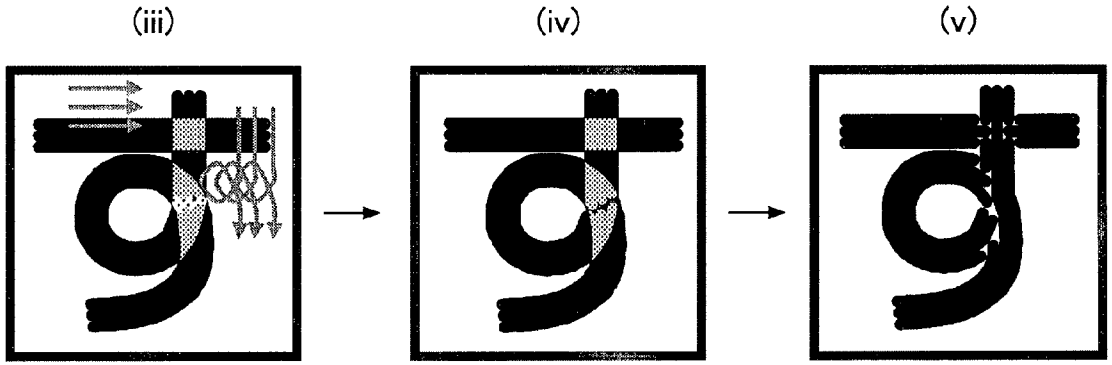

FIG. 15 is a flowchart illustrating an outline of a process carried out by the thermal rewritable medium drawing apparatus according to an embodiment. FIG. 16A illustrates an example of a process in which an ordinary character is drawn, and FIG. 16B illustrates an example of a process in which a bold-faced character is drawn.

In FIG. 15, when the process starts, information on a font-line core of a target character to be drawn that is formed of one stroke, or two or more strokes is acquired (step S11). A case (i) in FIG. 16A illustrates such a process of acquiring information on the font-line core of the (ordinary) target character in step S11. Note that the same process of acquiring information on the font-line core of a bold-faced target character is carried out as illustrated in the case (i) in FIG. 16A.

Referring back to FIG. 15, a stroke group composed of a series of continuous strokes is selected (step S12). A case (ii) in FIG. 16A illustrates such a process of selecting the stroke group composed of strokes for the (ordinary) target character in step S12. Note that the same process of selecting the stroke group is carried out for the bold-faced target character as illustrated in the case (ii) in FIG. 16A.

Subsequently, in a case of the bold-faced target character, parallel strokes are subsequently generated for increasing the stroke width of the target character (step S13). A case (iii) in FIG. 16B illustrates such a process of generating the parallel strokes for increasing the stroke width of the bold-faced target character in step S13.

Referring back to FIG. 15, an overlapped part of the strokes within the stroke group is subsequently removed (step S14). Cases (iv) in FIGS. 16A and 16B illustrate such a process of removing the overlapped part of the strokes within the stroke group in the respective ordinary character and the bold-faced character in step S14. In this example, the overlapped part of the loop of the character "su" of hiragana in Japanese is removed. Note that the overlapped part is derived in the process of drawing the loop of the character in a direction from top to bottom.

Referring back to FIG. 15, an overlapped part of the strokes between the stroke groups is subsequently removed (step S15). Cases (v) in FIGS. 16A and 16B illustrate such a process of removing the overlapped part of the strokes between the stroke groups in the respective ordinary character and the bold-faced character in step S15. In this example, the overlapped part obtained in intersections between the straight horizontal line of the target character and the loop of the target character is removed. Note that the overlapped part between the stroke groups is derived in the process of drawing the straight horizontal line from left to right and drawing the loop from top to bottom.

Referring back to FIG. 15, drawing data of the target character from which the overlapped part of the strokes within the stroke group and the overlapped part of the strokes between the stroke groups are removed are output (step S16), and drawing of the target character is carried out based on the drawing data to terminate the process.

Figure 17:
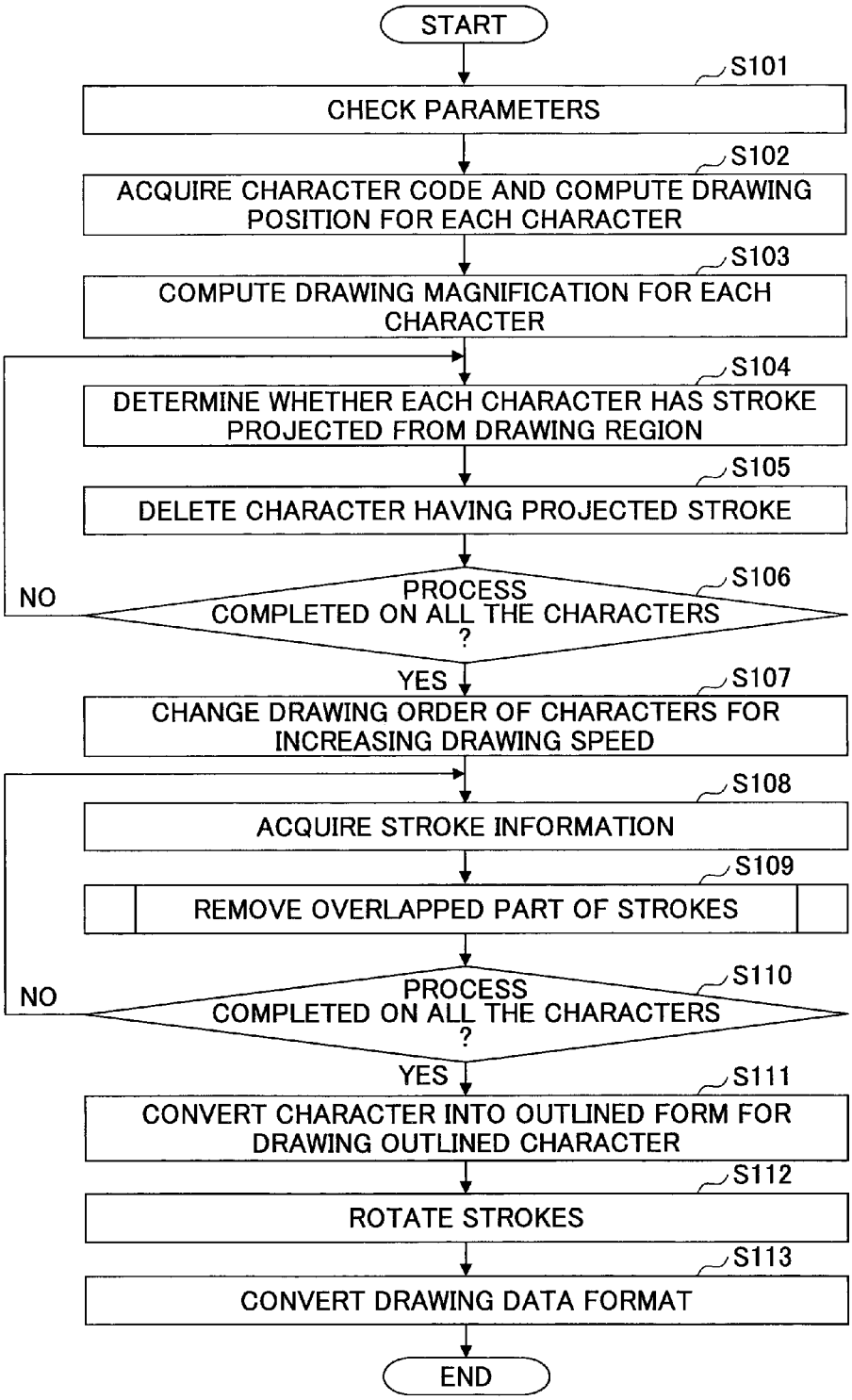
FIG. 17 is a flowchart illustrating an example of a process carried out by the thermal rewritable medium drawing apparatus according to the embodiment.

FIG. 17 is a flowchart illustrating an example of a process carried out by the thermal rewritable medium drawing apparatus according to an embodiment.

In FIG. 17, when the process starts, whether parameters given by a user include any formal defect is checked (step S101).

Subsequently, a character code, character spacing, and line spacing are obtained from the parameters given by the user to figure out a drawing position for each character, and the computed drawing position for each character is set in the drawing character management data (step S102).

Subsequently, drawing magnification for each character is computed and the computed drawing magnification for each character is set in the drawing character management data (step S103). The font is defined, for example, by coordinate values in a matrix of 256*256 pixels. The drawing magnification for enlarging this original font size of the character to the size (e.g., 3 cm in width and 2.5 cm in height) given by the user is computed. Since a stroke includes a stroke width, the drawing magnification is computed based on the stroke width having half the size (in height and width) smaller than the size given by the user. When drawing the bold-faced character, the drawing magnification is computed based on the number of parallel strokes specified by the user. For example, if three to nine strokes are drawn in parallel, the stroke width becomes three to nine times larger than the original. Thus, the drawing magnification is computed based on the stroke width having half the size of the resulting (enlarged) size.

Subsequently, whether the size of the character exceeds a drawing range specified by the user or an allowable drawing range (≈width of a medium) is determined for each character from the top character in the list (step S104). If the rotation of the character is specified, whether the strokes of the rotated character project from the drawing range or allowable drawing range is checked.

Subsequently, if the character includes the projected strokes, such a character is eliminated from a list of characters subject to drawing (i.e., deleting the drawing character management data of that character) (step S105).

Subsequently, whether the above process has been completed on all the characters in the list is determined (step S106). If the process has not been completed on all the characters in the list ("NO" in step S106), the process of determining whether the character includes projected strokes is carried out for the next character (back to step S104).

If, on the other hand, the process has been completed on all the characters in the list ("YES" in step S106), the drawing order of characters in the list is changed for increasing the drawing speed (step S107). For example, if the characters in lines are drawn in horizontal line orientations, an initial definition (default) of the drawing order includes drawing the character in lines in a left-to-right direction and drawing in a top-to-bottom direction. However, since there is a long distance from the right end of a first character line to the left end of a second character line below the first character line, drawing the characters utilizing the above definition of drawing order may take a long time. Thus, the drawing order is changed from a left-to-right direction to a right-to-left direction on every other line.

Subsequently, stroke information is acquired from the font data for each character based on the determined drawing order (step S108). That is, coordinates of the stroke are acquired from the font data based on the previously defined drawing magnification. In a case of drawing the ordinary character, the stroke information is acquired from the stroke font, and in a case of drawing an outlined character, the stroke information is acquired from the outlined font.

Subsequently, an overlapped part of the strokes is removed (step S109). Since the overlapped part of the strokes generates heat, this process is conducted for not creating the overlapped part of the strokes by dividing the strokes into appropriate parts or shorting some of the strokes or deleting some of the strokes. Note that the stroke is line segment information; however, the stroke includes a stroke width. Thus, it may be necessary to remove an overlapped part not only in a case where the strokes intersect each other but also in a case where the strokes approach each other. Details of the process of removing the overlapped part will be described later.

Next, whether the above process has been completed on all the characters in the list is determined (step S110). If the process has not been completed on all the characters in the list ("NO" in step S110), the process of determining whether the character includes projected strokes is carried out for the next character (back to step S108).

If, on the other hand, the process has been completed on all the characters in the list ("YES" in step S110), the process of converting the target character into an outlined form is carried out (step S111). This process is only carried out if the outlined character is desired to be drawn.

Subsequently, the strokes are rotated based on the parameters (step S112). Since the strokes are defined by endpoints of coordinates of the lines, the endpoints of coordinates of the lines may be rotated based simply on the parameters.

Subsequently, the data format of the strokes utilized in the internal process are converted into the drawing data format construed by a drawing controller (lower controller) (step S113) to thereby end the process.

Figure 18:
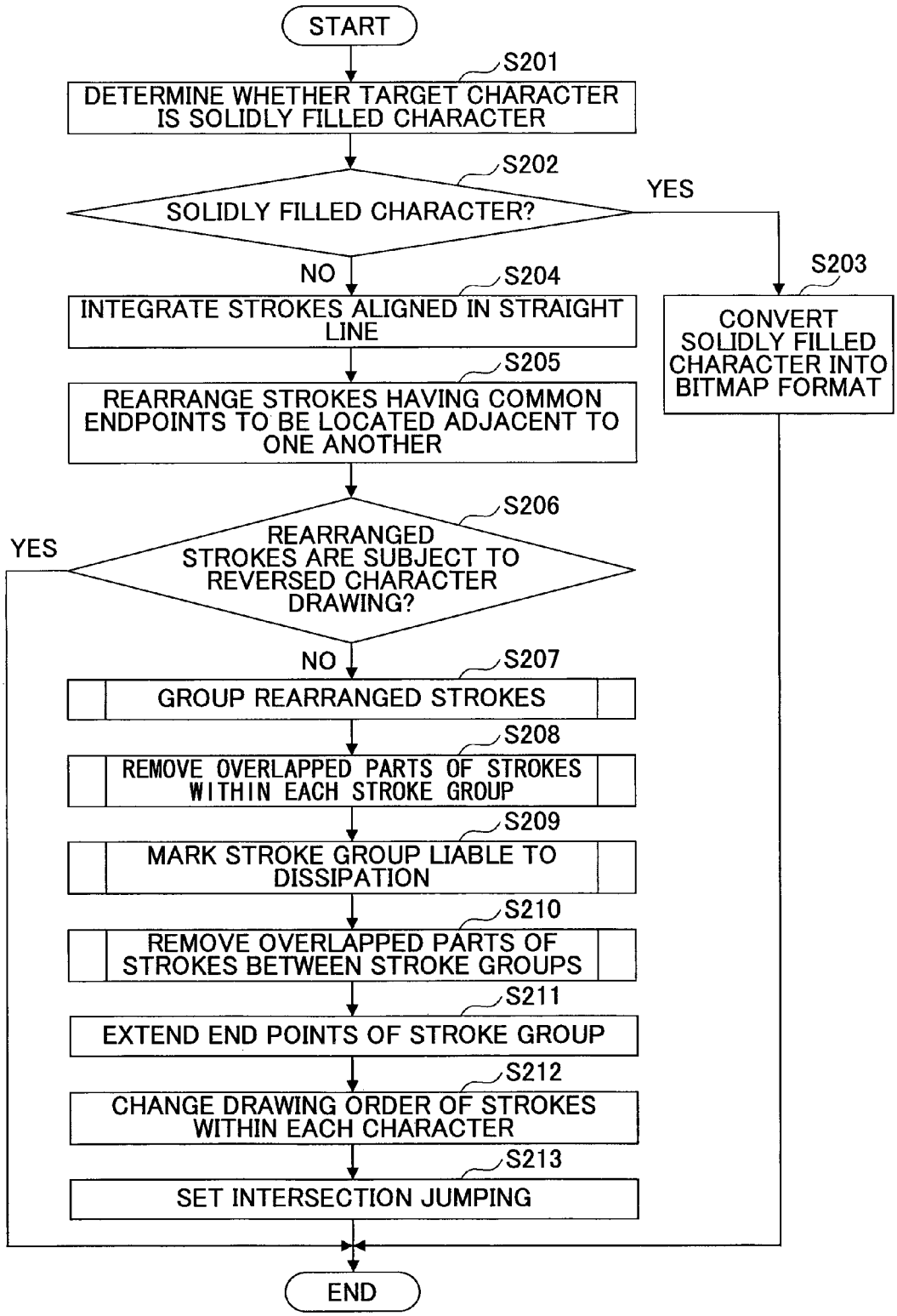
FIG. 18 is a flowchart illustrating an example of a process of removing an overlapped part of the strokes.

FIG. 18 is a flowchart illustrating an example of a process of removing an overlapped part of the strokes (step S109 in FIG. 17).

In FIG. 18, when the process of removing the overlapped part of the strokes starts, whether one of the target characters is a solidly filled character is determined (steps S201, S202). The solidly filled character indicates those characters hard to be expressed by the ordinary strokes, such as a solidly filled round shape or a solidly filled star shape, which are defined by parallel strokes. Since line data at extremely fine pitches of such characters are stored in the font data, some of the lines forming the character may need to be removed (thinned out) corresponding to the stroke width of the target character. The solidly filled character is determined based on whether approximately all the strokes are aligned in parallel.

If the target character is determined as the solidly filled character ("YES" in step S202), the solidly filled character is temporarily converted into a bitmap format and then the bitmapped character is scanned internally to define the strokes (step S203). The process is terminated thereafter.

If, on the other hand, the target character is not the solidly filled character ("NO" in step S202), the strokes are integrated (step S204). That is, the strokes stored in the font data are aligned in a straight line; however, two or more strokes that are overlapped are defined as separate entities. Thus, the overlapped lines are integrated and defined as one straight line.

Subsequently, a storing order of all the strokes is changed such that the strokes having identical endpoints are located adjacent to one another, and then the strokes rearranged in the changed storing order are stored (step S205).

Next, whether the stored rearranged strokes are subject to reversed character drawing is determined (step S206).

If the stored rearranged strokes are subject to the reversed character drawing ("YES" in step S206), the process of removing the overlapped part of the strokes is terminated here.

In this case, although there is the overlapped part to be removed, the stored character data themselves are not subject to drawing. Accordingly, subsequent overlapped part removing steps are not necessary.

If the target character is not subject to the reversed character drawing ("NO" in step S206), the stored rearranged strokes are grouped (step S207). This grouping process is carried out because the two or more strokes having common endpoints may be continuous. Thus, the continuous strokes are drawn by a laser without switching off laser emission. Note that this group is a stroke unit formed of a series of continuous strokes. Details of the process of grouping the continuous strokes will be described later.

Next, whether there is any overlapped part within the stroke group is determined, and if there is an overlapped part within the stroke groups, the strokes having the overlapped part are subject to division, shortening or deletion (step S208). Details of the process of dividing, shortening or deleting the strokes having the overlapped part within the stroke group will be described later.

Subsequently, the stroke groups that are liable to dissipation are marked (step S209). When the strokes having the overlapped part are divided, shortened or deleted, the strokes having the overlapped part may dissipate entirely, or the overlapped part sandwiched between the two strokes may dissipate. As a result, viewability of the strokes may be significantly degraded due to lack of the amount of information. Thus, it may be desirable to mark those strokes liable to dissipation so as not to divide or shorten such strokes. Details of the process of marking the strokes liable to dissipation will be described later.

Subsequently, two stroke groups are selected and an overlapped part of the strokes between the selected stroke groups are removed (step S210). Details of the process of removing the overlapped part of the strokes between the stroke groups will be described later.

Subsequently, the end points of the stroke groups are extended (step S211). Since end point parts of the stroke groups tend to easily release heat, the actually drawn strokes may be shorter than the desired lengths of the stroke groups. Thus, the desired lengths of the stroke groups may be drawn by extending the end point parts of the stroke groups.

Subsequently, the drawing order of the strokes within a character is rearranged (changed) (step S212). The drawing time of drawing the strokes of the character by a laser marker may be reduced by drawing the strokes in an efficient drawing order and reducing unnecessary jumping (non-laser emitting movement).

Subsequently, intersection jumping is set (step S213). The intersection jumping indicates a laser marker jumps at the same speed as a marking speed. In general, the jumping of the laser marker is conducted at a speed higher than the marking speed. Since inserting waiting time is no longer required by setting the jumping speed of the laser marker for jumping between the marks the same as the marking speed of the laser marker, the drawing time of drawing the strokes of the character may be reduced. The process is terminated thereafter.

Figure 19:
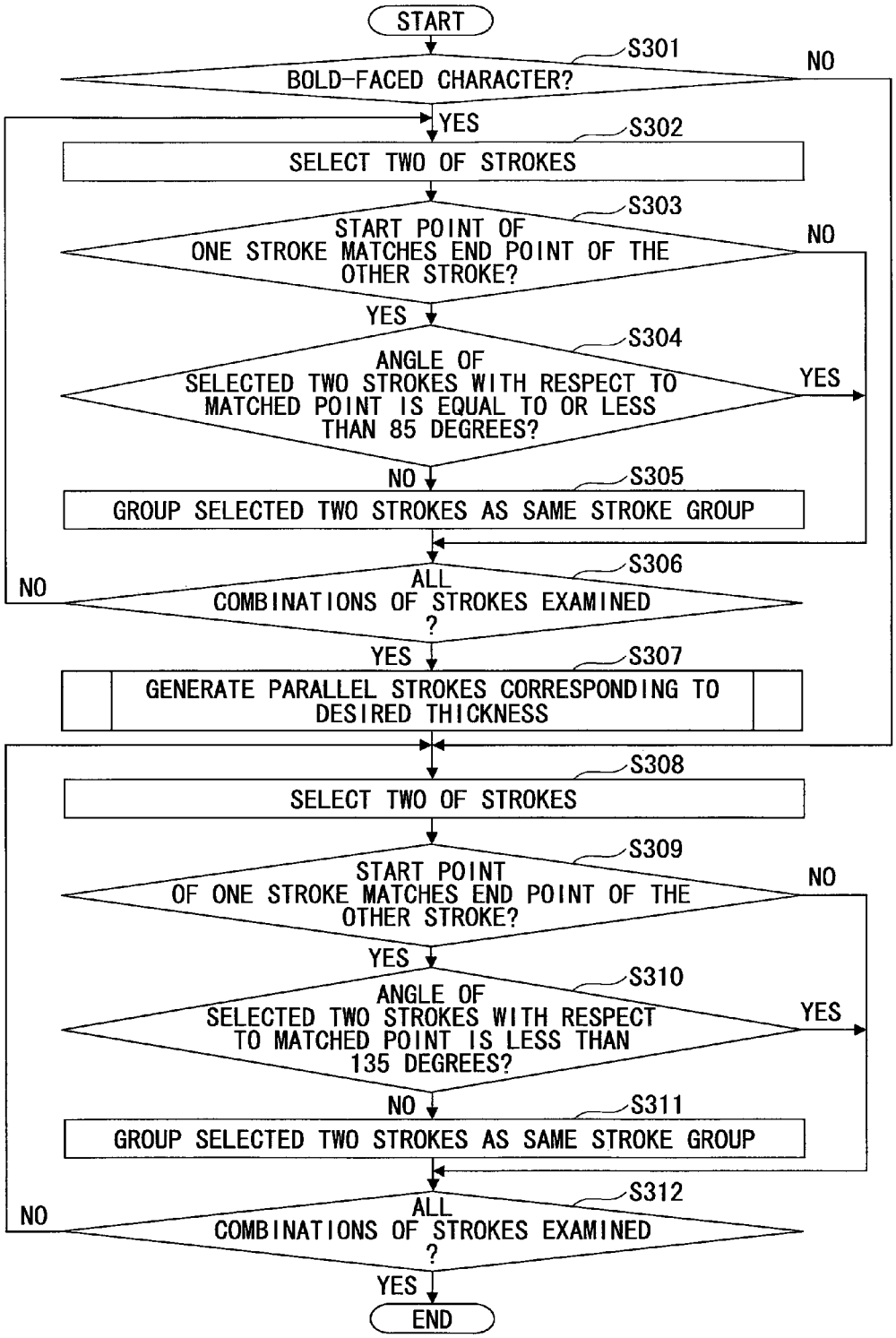
FIG. 19 is a flowchart illustrating an example of a process of grouping the strokes.

FIG. 19 is a flowchart illustrating an example of a process of grouping the strokes (step S207 in FIG. 18).

In FIG. 19, when the process of grouping the strokes starts, whether the target character is a bold-faced character is determined (step S301). Whether the target character is a bold-faced character is determined based on a parameter given by the user.

If the target character is the bold-faced character ("YES" in step S301), the following processes (steps S302 to S307) for the bold-faced character are carried out. If, on the other hand, the target character is not the bold-faced character ("NO" in step S301), the following processes (steps S302 to S307) for the bold-faced character are not carried out.

In the processes for the bold-faced character, two strokes are initially selected (step S302), and whether an end point of one of the selected two strokes matches a start point of the other stroke is determined (step S303).

Figure 20:
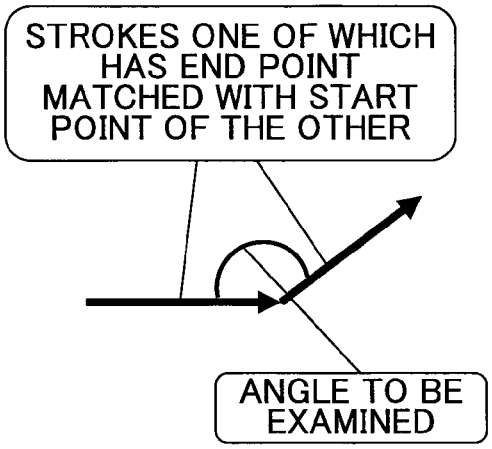
FIG. 20 illustrates an example of an angle of the two strokes where an end point of one stroke matches a start point of the other stroke.

If the end point of one of the selected strokes matches the start point of the other stroke ("YES" in step S303), whether the angle of the two strokes with respect to the matched point exceeds 85 degrees is determined (step S304). FIG. 20 illustrates an example of an angle of the two strokes where the end point of one stroke matches the start point of the other stroke. Note that the "angle of 85 degrees" is described later.

Referring back to FIG. 19, if the angle of the selected two strokes with respect to the matched point exceeds 85 degrees ("NO" in step S304), the two strokes are grouped as the same stroke group (step S305).

If, on the other hand, the end point of one of the selected strokes does not match the start point of the other stroke ("NO" in step S303), or the angle of the selected two strokes with respect to the matched point does not exceed 85 degrees ("YES" in step S304), the selected two strokes are not groups as the same stroke group (does not carry out step S305).

Subsequently, whether all the combinations of the strokes have been examined on the above processes in steps S303 and S304 is determined (step S306). If not all the combinations of the strokes have been examined ("NO" in step S306), the process of selecting two strokes in step S302 is carried out (back to step S302).

If, on the other hand, all the combinations of the strokes have been examined ("YES" in step S306), parallel strokes are generated corresponding to a desired thickness of the stroke (step S307). For example, if the bold face is expressed with three strokes, two parallel strokes are generated one at each side of the target stroke. Details of the process of generating parallel strokes will be described later.

Next, in cases of either the bold-faced target character or the ordinary target character, two of the strokes are selected (step S308), and whether an end point of one of the selected two strokes matches a start point of the other stroke is determined (step S309).

If the start point of one of the selected strokes matches the end point of the other one ("YES" in step S309), whether the angle of the two strokes with respect to the matched point exceeds 135 degrees is determined (step S310). Note that the "angle of 135 degrees" is described later.

If the angle of the two strokes with respect to the matched point exceeds 135 degrees ("NO" in step S310), the two strokes are grouped as the same stroke group (step S311).

If, on the other hand, the end point of one of the selected strokes does not match the start point of the other stroke ("NO" in step S309), or the angle of the selected two strokes with respect to the matched point does not exceed 135 degrees ("YES" in step S310), the selected two strokes are not grouped as the same stroke group (does not carryout step S311).

Subsequently, whether all the combinations of the strokes have been examined is determined (step S312). If not all the combinations of the strokes have been examined ("NO" in step S312), the process of selecting two strokes in step S302 is carried out (back to step S308).

If, on the other hand, all the combinations, of the strokes have been examined ("YES" in step S312), the process is terminated.

Figure 1:
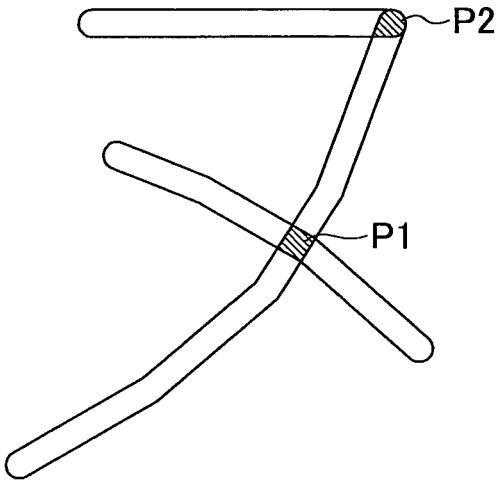
FIG. 1 is a diagram illustrating an example of a character drawn on a thermal rewritable medium by laser beams.
Figure 2:
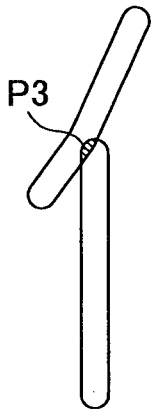
FIG. 2 is a diagram illustrating an example of a character drawn on the thermal rewritable medium by the laser beams.

In the above processes, the angle of the selected two strokes with respect to the matched point is important because the selected two strokes having an acute angle with respect to the matched point may preferably be grouped in different stroke groups (see, for example, the acute angle of a bending part formed at a point P2 illustrated on the right hand side of FIG. 1). Since redirecting a marking direction while marking of the bending part of the two strokes having the acute angle by a laser beam may take a long time due to the mirror inertia, the laser beam may be applied to the bending part for a long time and the bending part may be overheated as a result. Accordingly, it is desirable that the two strokes forming the bending part be grouped as plural of the stroke groups and the laser beam be temporarily turned off while marking of the bending part of the two strokes having the acute angle.

In a case of the bold-faced character, it is desirable that newly generated parallel strokes be grouped. Since angle conditions are different in grouping the parallel strokes, grouping may be required twice.

Figure 21A:
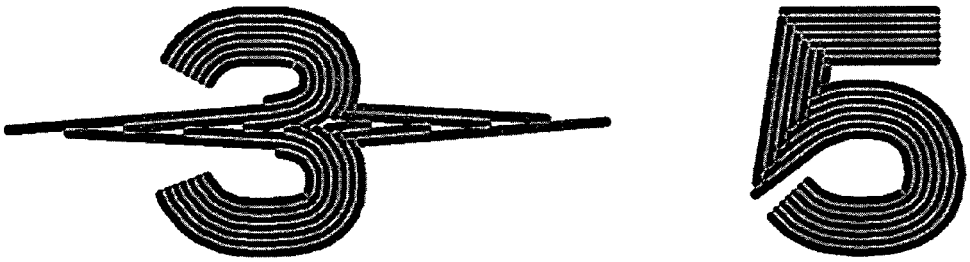
FIGS. 21A to 21C are diagrams illustrating examples of results obtained by drawing the characters based on different angles of grouping the strokes.
Figure 21B:
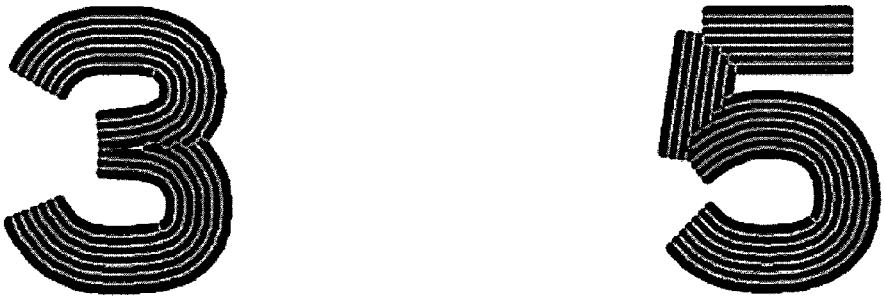
Figure 21C:
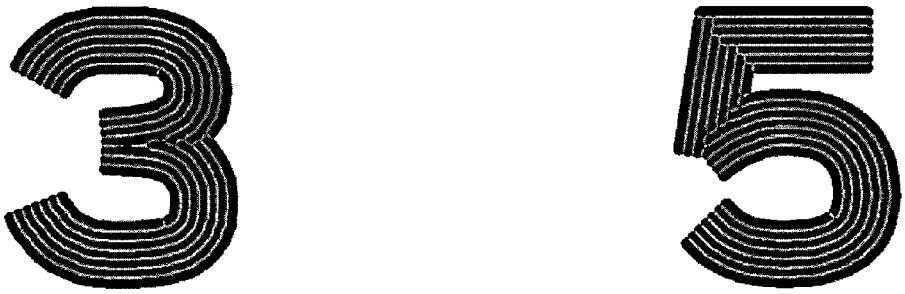

If the angle condition is not provided, the bending part of the two strokes having the acute angles may result in examples illustrated in FIG. 21A. If the angle of 135 degrees is set to the angle condition, which is the same angle used in the subsequent process, the bending parts of the two strokes having the acute angles may result in examples illustrated in FIG. 21B. That is, a top-left part of "5" exhibits degraded appearance. Thus, the appropriate angle of 85 degrees applied in the process, and examples illustrated in FIG. 21C are obtained as a result.

Figure 22:
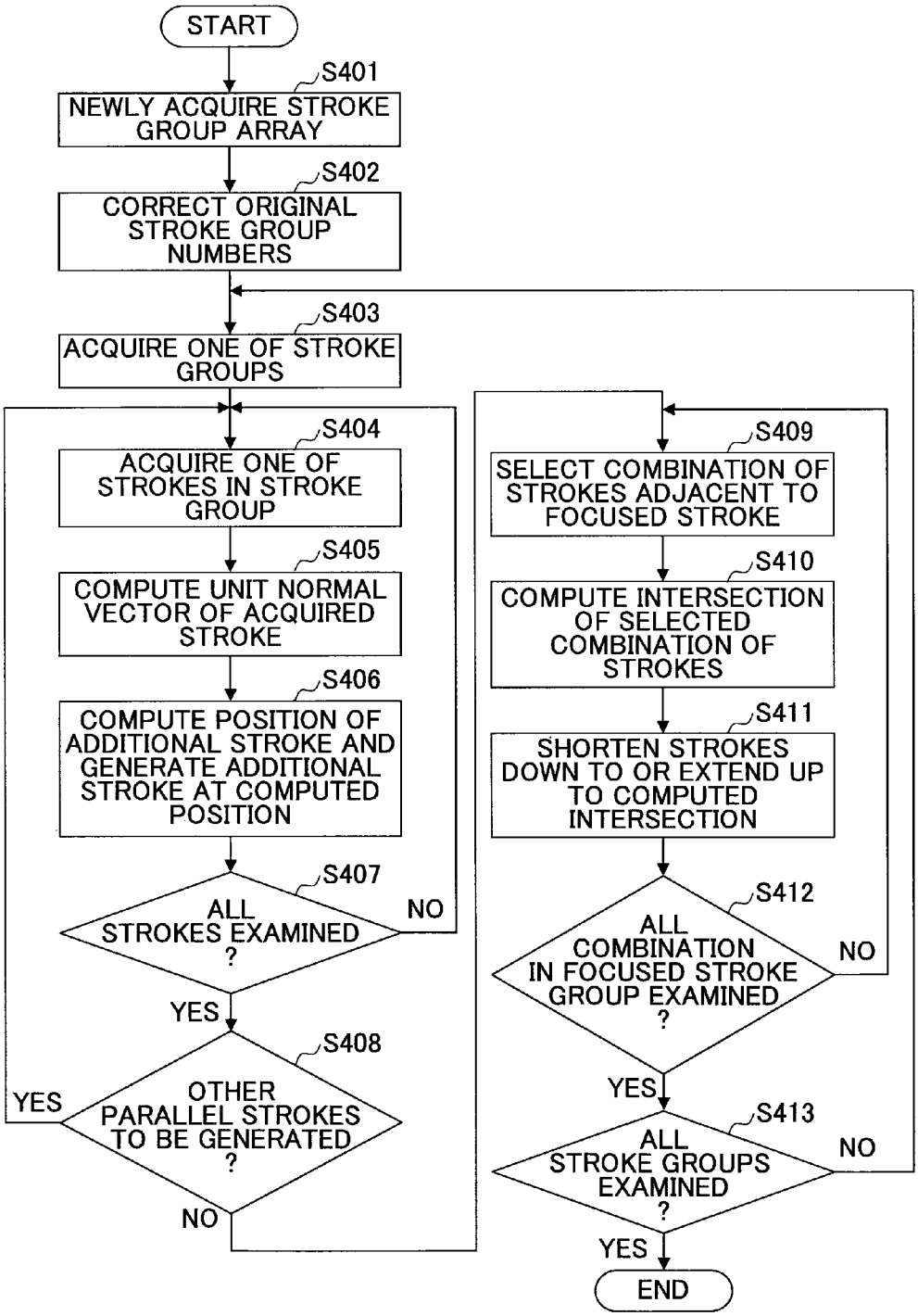
FIG. 22 is a flowchart illustrating an example of a process of generating parallel strokes to make a desired character to be bold-faced.

FIG. 22 is a flowchart illustrating an example of a process of generating parallel strokes corresponding to a desired thickness (step S307 in FIG. 19).

In FIG. 22, when the process starts, a stroke group array (drawing character management data) necessary for storing is newly acquired (step S401).

Subsequently, the original stroke group numbers are corrected (step S402). The stroke groups are identified by different stroke numbers obtained by incrementing a number starting with "0" by one. The different stroke numbers are changed based on the number of parallel strokes specified by the user. For example, if the bold face is expressed by arranging three parallel strokes in parallel with one another, the current stroke group numbers "0, 1, 2, 3, - - - , n" are respectively changed into new stroke group numbers "1, 4, 7, 10, - - - , 3n+1". If the bold face is expressed by arranging five parallel strokes in parallel with one another, the current stroke group numbers "0, 1, 2, 3, - - - , n" are respectively changed into new stroke group numbers "2, 7, 12, 17, - - - , 5n+2". That is, when the number of parallel strokes is "i", parallel stroke groups generated in parallel with the identical stroke group are successively stored and the current stroke is located in the center of the successive parallel strokes. This process is provided for determining which one of the strokes is the central stroke in the subsequent process.

Subsequently, one of the stroke groups is acquired (step S403), one of the strokes in the acquired stroke group is acquired (step S404), and a unit normal vector of the acquired stroke is computed (step S405). The unit normal vector of the stroke is computed based on an equation of a straight line passing through the start point and the end point of the strokes.

Subsequently, an additional stroke having the same length as the length the focused stroke is generated at a position where an amount of a stroke width is shifted in the unit normal vector direction (step S406). More accurately, the shifting position is reduced in the amount of the overlapped width (fill overlap) specified by the user.

Subsequently, whether all the strokes in the focused on stroke group are examined is determined (step S407). If not all the strokes in the focused on stroke group have been examined ("NO" in step S407), the process of acquiring one of the strokes in the focused on stroke group in step S404 is carried out (back to step S404).

If all the strokes in the focused on stroke group have been examined ("YES" in step S407), whether to generate no other parallel strokes is determined based on the number of strokes specified by the user (step S408). If there are other parallel strokes to be generated ("NO" in step S408), the process of acquiring one of the strokes in the focused on stroke group in step S404 is carried out (back to step S404).

If, on the other hand, there are no other parallel strokes to be generated ("YES" in step S408), a next process will be carried out.

Figure 23:
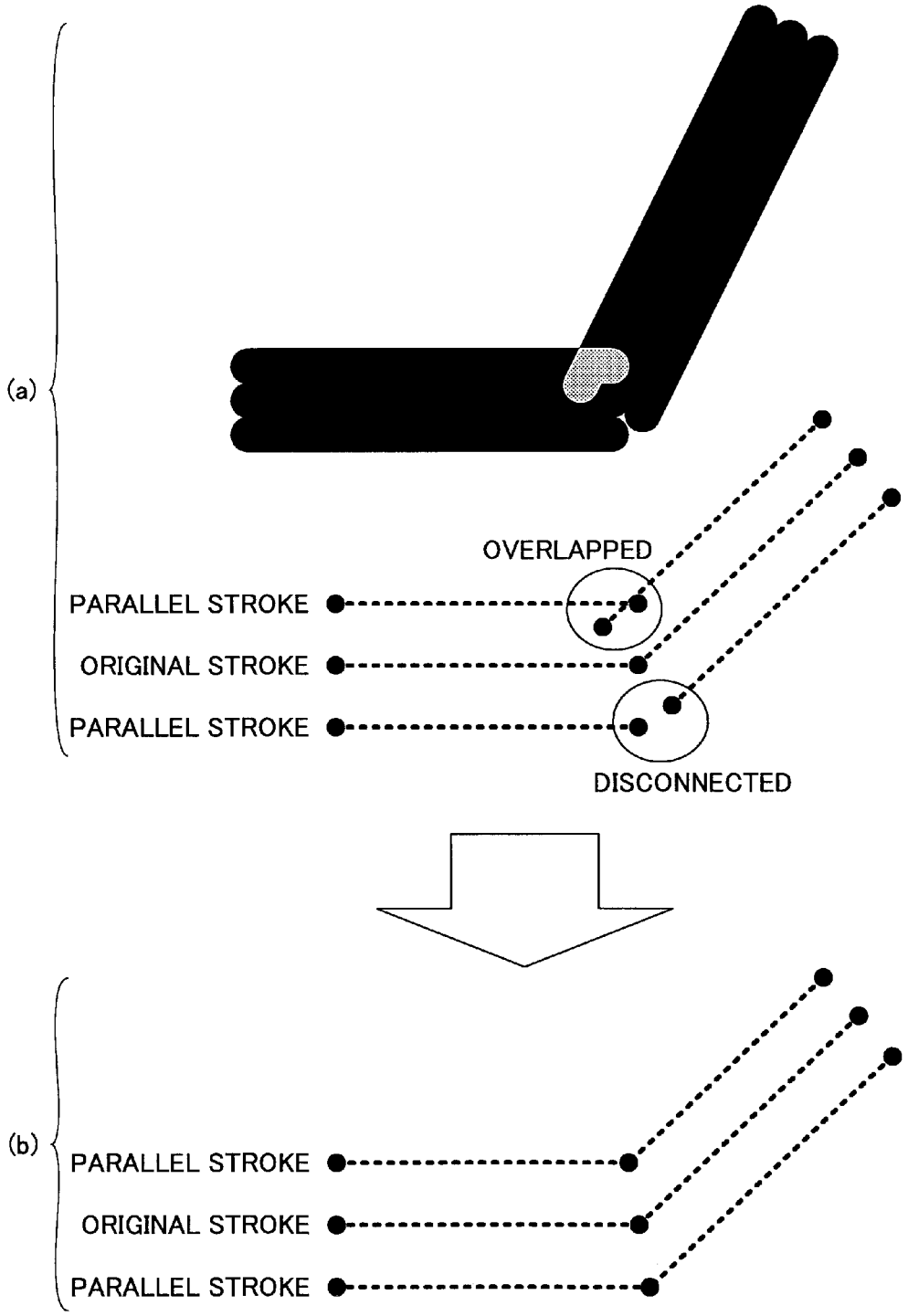
FIG. 23 is a diagram illustrating an example of generating the parallel strokes.

At this moment, the successive parallel strokes are not appropriately connected to one another, and the bending part of the inner side parallel strokes is overlapped and the bending part of the outer side parallel strokes is broken (disconnected) as illustrated in (a) of FIG. 23. Thus, this overlapped part of the inner side parallel strokes and the disconnected part of the outer side parallel strokes are corrected in the subsequent processes.

Referring back to FIG. 22, the adjacent parallel strokes associated with the same stroke group (e.g., the top strokes in (a) of FIG. 23) are selected (step S409), and the intersection of the selected parallel strokes is computed (step S410).

Subsequently, the strokes are shortened down to or extended to reach the computed intersection (step S411).

Subsequently, whether all the combinations of the strokes in the focused on stroke group have been examined is determined (step S412). If not all the combinations of the strokes in the focused on stroke group have been examined ("NO" in step S412), the process of selecting adjacent parallel strokes associated with the same stroke group in step S409 is carried out (back to step S409).

If, on the other hand, all the combinations of the strokes in the focused on stroke group have been examined ("YES" in step S412), whether all the stroke groups have been examined is determined (step S413). If not all the stroke groups have been examined ("NO" in step S413), the process of acquiring one of the stroke groups in step S403 is carried out (back to step S403).

If all the stroke groups have been examined ("YES" in step S413), the process is terminated.

Figure 24:
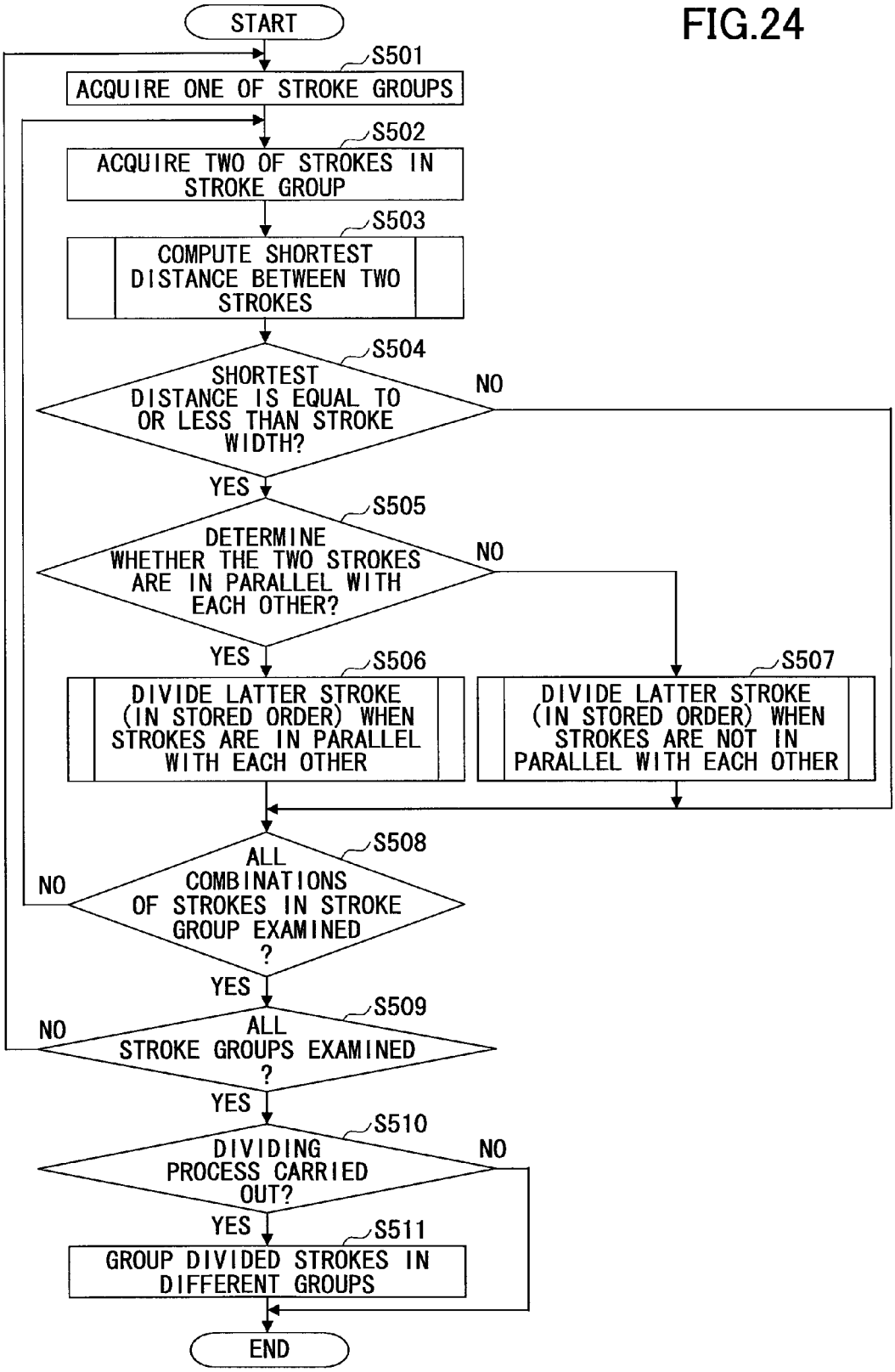
FIG. 24 is a flowchart illustrating an example of a process of removing an overlapped part of the strokes within the same stroke group.

FIG. 24 is a flowchart illustrating an example of a process of removing overlapped parts of the strokes in the stroke group (step S208 in FIG. 18).

In FIG. 24, when the process of removing overlapped parts of the strokes in the stroke group starts, one of the stroke groups is acquired (step S501).

Subsequently, two of the strokes in the stroke group are acquired (step S502).

Subsequently, the shortest distance between the two strokes is computed (step S503). Details of the process of computing the shortest distance between the two strokes will be described later.

Subsequently, whether the computed shortest distance between the two strokes is equal to or less than the stroke width is determined (step S504).

If the computed shortest distance between the two strokes is greater than the stroke width ("NO" in step S504), the two strokes are not overlapped and thus, the process of computing the shortest distance between the next combination of the strokes is carried out.

If, on the other hand, the computed shortest distance between the two strokes is equal to or less than the stroke width ("YES" in step S504), the two strokes are overlapped and whether the two strokes are in parallel with each other is subsequently determined (step S505).

If the two strokes are in parallel with each other ("YES" in step S505), the latter stroke stored after the former stroke is stored is subject to division for parallel strokes (step S506). Details of the process of dividing the latter stroke stored after the former stroke when the strokes are parallel with each other will be described later.

If the two strokes are not in parallel with each other ("NO" in step S505), the latter stroke stored after the former stroke is stored is subject to division for non-parallel strokes (step S507). Details of the process of dividing the latter stroke stored after the former stroke when the strokes are not parallel with each other will be described later.

Regardless of the strokes being parallel with each other or non-parallel with each other, the latter one of the strokes stored is subject to division. In this manner, when there are the overlapped parts of the strokes within one stroke group, the disconnection or the fragmentation may be prevented in adjacent parts between the strokes.

If the shortest distance between the strokes is greater than the stroke width ("NO" in step S504), and whether the all the strokes have been examined within the focused on stroke group is examined (step S508) after the dividing of the stroke (steps S506 and S507). If the obtained result indicates that not all the strokes have been examined within the focused on stroke group ("NO" in step S508), the process of acquiring the combination of strokes in step S502 is carried out (back to step S502).

If all the combinations of the strokes in the focused on stroke group have been examined ("YES" in step S502), whether all the stroke groups have been examined is determined (step S509). If not all the stroke groups have been examined ("NO" in step S509), the process of acquiring one of the stroke groups in step S501 is carried out (back to step S501). If, on the other hand, all the stroke groups have been examined ("YES" in step S509), whether the dividing process has been carried out is examined (step S510).

If the dividing process has been carried out ("YES" in step S510), the divided strokes are grouped in different groups (step S511) and the process is terminated. If the dividing process has not been carried out ("NO" in step S510), the process is terminated without carrying out the dividing process.

Figure 25:
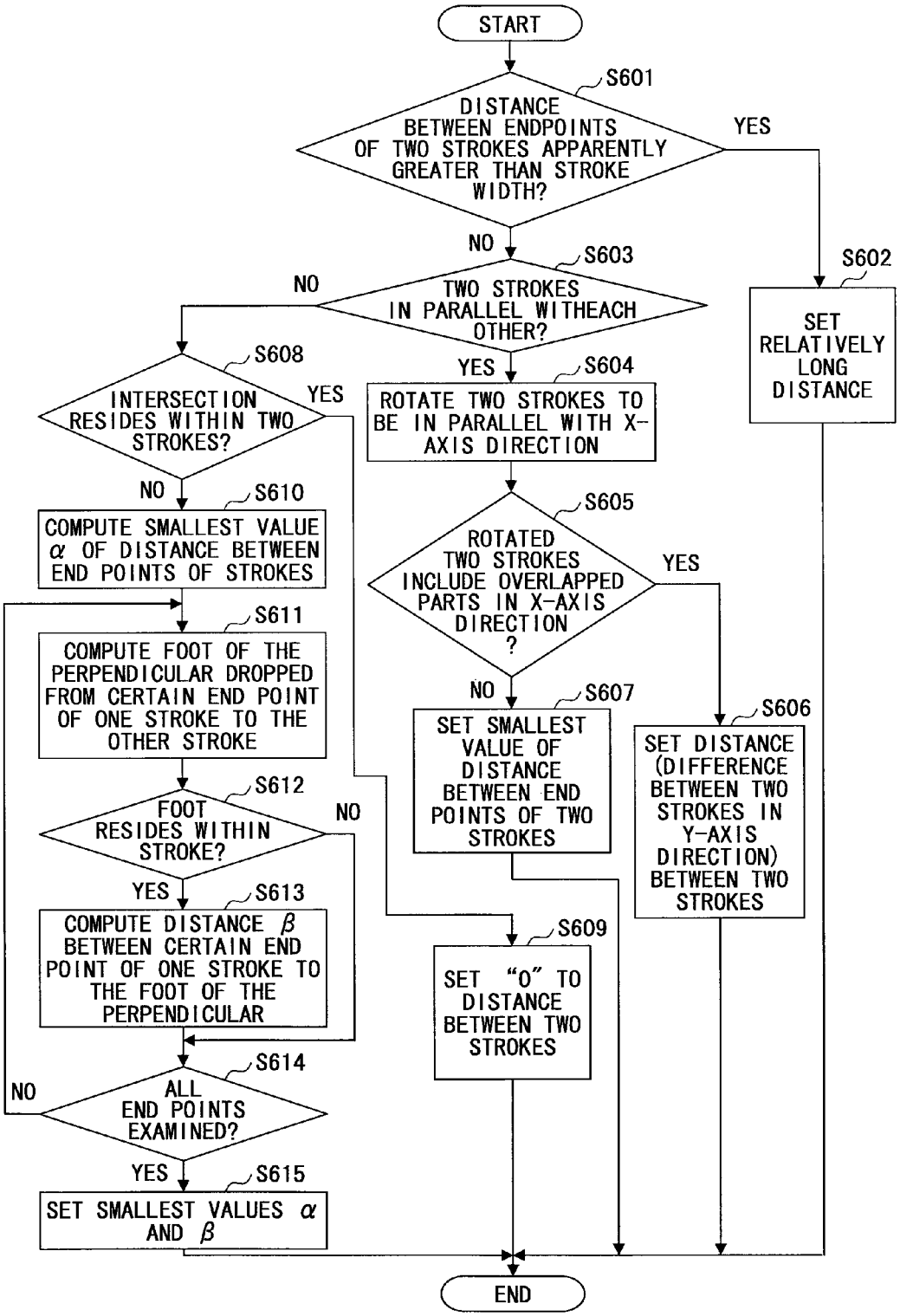
FIG. 25 is a flowchart illustrating an example of a process of computing the shortest distance between the strokes.

FIG. 25 is a flowchart illustrating an example of a process of computing the shortest distance between the two strokes (step S503 in FIG. 24).

In FIG. 25, when the process of computing the shortest distance between the two strokes starts, whether a distance between end points of the two strokes is greater than the stroke width is determined (step S601). That is, whether both a distance between x-coordinates of the endpoints of the two strokes and a distance between y-coordinates of the end points of the two strokes are greater than the stroke width is determined (step S601).

If the computed shortest distance between the two strokes is apparently greater than the stroke width ("YES" in step S601), the two strokes are not overlapped. Thus, a relatively long distance is subsequently set (step S602), and the process is terminated without computing the accurate distance between the two strokes. The aim of the process of computing the shortest distance between the two strokes is to determine whether the two strokes are overlapped. Thus, when the distance between the two strokes is apparently long, it is not necessary to compute such a distance.

If, on the other hand, the computed shortest distance between the two strokes is equal to or less than the stroke width ("NO" in step S601), whether the two strokes are in parallel with each other is determined (step S603). Whether the two strokes are in parallel with each other is determined by comparing slopes of respective equations of two straight lines passing through the start points and the end points of the two strokes.

If the two strokes are in parallel with each other ("YES" in step S603), both strokes are rotated to be in parallel with an x-axis direction (step S604).

Subsequently, whether the rotated strokes include an overlapped part is determined (step S605).

Figure 26A:
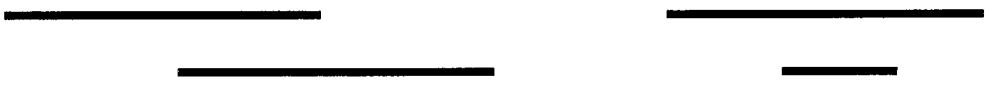
FIGS. 26A and 26B are diagrams illustrating examples of the strokes that are in parallel with each other.

If the rotated strokes include an overlapped parts in the x-axis direction ("YES" in step S605), the distance between the straight lines (i.e., the difference between the straight lines in the y-axis direction) corresponds to a smallest value of the distance between the strokes. Thus, the obtained value is set as the distance between the two strokes (step S606), and the process is terminated. Examples of such a case are illustrated in FIG. 26A.

Figure 26B:
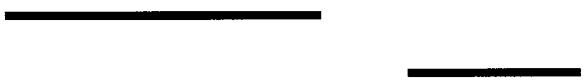

Referring back to FIG. 25, if the rotated strokes include no overlapped part in the x-axis direction ("NO" in step S605), a smallest value of the distance between the end points of the two strokes corresponds to the smallest value of the distance between the two strokes. Thus, the smallest value of the distance between the endpoints of the two strokes is computed and the computed smallest value between the endpoints of the two strokes is set (step S607), and the process is terminated. Examples of such a case are illustrated in FIG. 26B.

Referring back to FIG. 25, if the two strokes are not in parallel with each other ("NO" in step S603), the intersection of the two strokes is computed and whether the intersection resides within the two strokes is determined (step S608).

If the intersection resides within the two strokes ("YES" in step S608), "0" is set to the distance between the two strokes (step S609), and the process is terminated.

If there is no intersection residing within the two strokes ("NO" in step S608), the smallest distance a between the end points of the two strokes is computed (step S610).

Subsequently, a perpendicular line is dropped from a certain end point of one stroke perpendicular to the other stroke, and coordinates of a foot of the perpendicular line at the other stroke are computed (step S611).

Subsequently, whether the foot of the perpendicular line resides within the strokes is determined (step S612).

Figure 27:
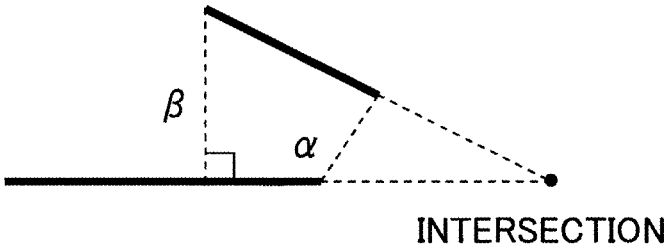
FIG. 27 is a diagram illustrating an example of the strokes that are not in parallel with each other and include no intersection between the strokes.

If the foot of the perpendicular line resides within the other stroke ("YES" in step S612), a distance $\beta$ between the certain end point and the foot of the perpendicular line is computed (step S613). FIG. 27 illustrates examples of the distance $\alpha$ and the distance $\beta$ between the two strokes.

Referring back to FIG. 25, if the foot of the perpendicular line does not reside within the stroke ("NO" in step S612), no process is carried out.

Subsequently, whether all the end points have been examined is determined (step S614). If not all the end points have been examined ("NO" in step S614), the process of computing the foot of the perpendicular line in step S611 is carried out (back to step S611).

If, on the other hand, all the end points have been examined ("YES" in step S614), the smallest values $\alpha$ and $\beta$ are set to the respective distances between the strokes (step S615), and the process is terminated.

Figure 28:
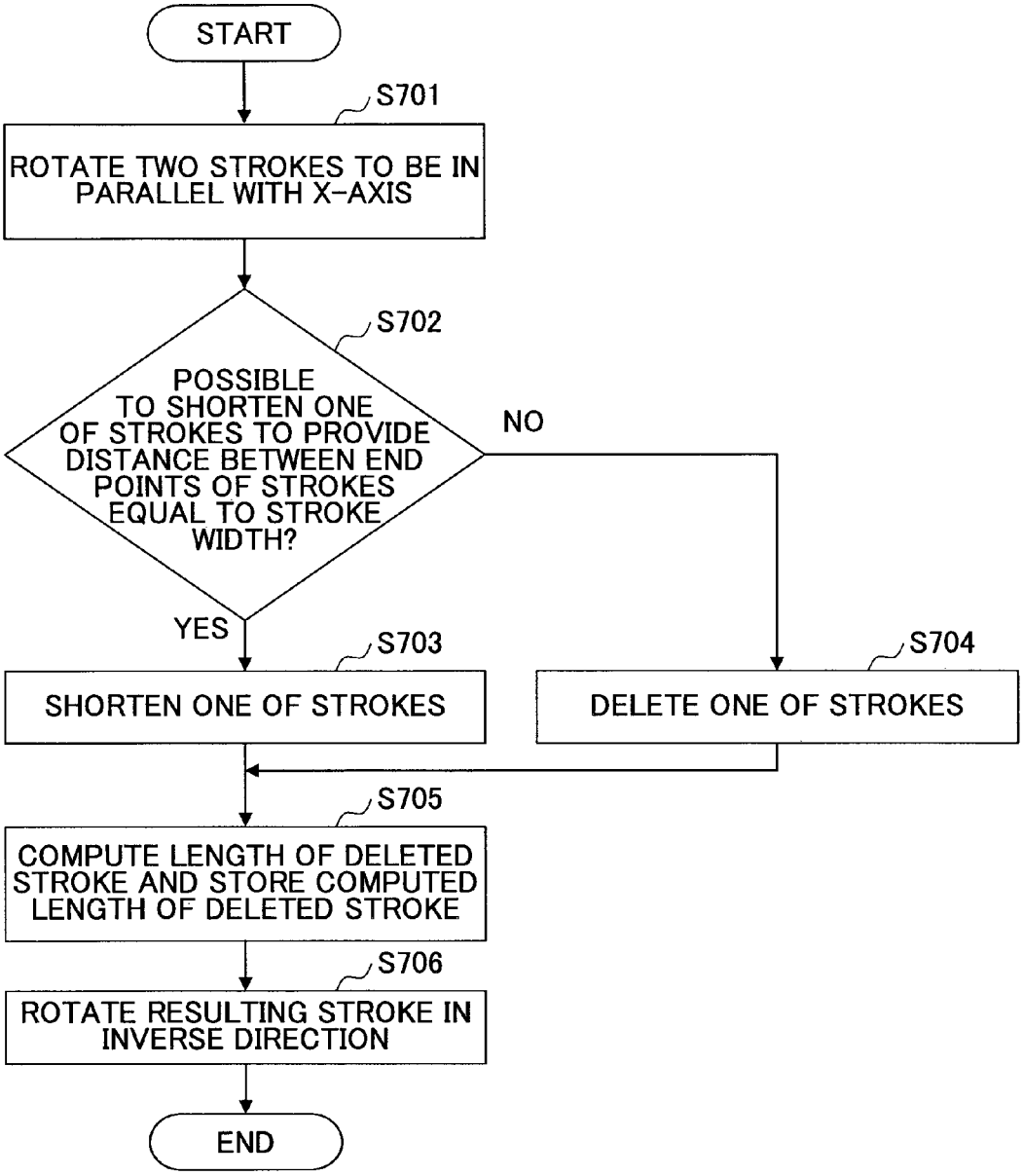
FIG. 28 is a flowchart illustrating an example of a process of dividing the strokes when the strokes are arranged in parallel with each other.

FIG. 28 is a flowchart illustrating an example of a process of dividing the strokes when the strokes are in parallel with each other (step S506 in FIG. 24).

In FIG. 28, when the process of dividing the strokes in the stroke group starts, the two strokes are rotated to be in parallel with the x-axis (step S701). More specifically, the following process is carried out.

Initially, respective rotational angles to the x-axis are computed. If the respective sin and cos of the rotational angles to the x-axis are defined as "sin t" and "cos t", and a straight line equation of the stroke is "ax+by+c=0", the rotational angles "sin t" and "cost" to the x-axis are obtained from following equations.

$$\sin t=-a/\mathrm{sqrt}(a*a+b*b)$$

$$\cos t=b/\mathrm{sqrt}(a*a+b*b)$$

The respective strokes are rotated in reverse directions to be in parallel with the x-axis. If coordinate values of an end point of the stroke are defined as "xs, ys", and coordinate values of an end point of the rotated stroke are defined as "xs0, ys0", the coordinate values (xs0, ys0) are computed by the following equations.

$$xs0=\cos t*xs+\sin t*ys$$

$$ys0=-\sin t*xs+\cos t*ys$$

Subsequently, whether it is possible to shorten one of the strokes for adjusting the distance between the end points of the two strokes to be equal to the stroke width is determined (step S702). More specifically, the following process is carried out.

Initially, the shortest distance between the strokes is computed. If the x-coordinates of the end points of the rotated two strokes are overlapped, the shortest distance obtained may be a distance between the parallel strokes. If the x-coordinates of the end points of the rotated two strokes are not overlapped, the shortest one of the distances obtained between the end points of the strokes may be the shortest distance between the strokes. Note that since each stroke has two end points, there are four distances between the end points of the strokes in total.

If the shortest distance obtained is less than the stroke width t, the overlapped end points of the rotated two strokes in the x-coordinate are examined. If the two strokes are not overlapped, it is determined that one of the strokes may be shortened. If, on the other hand, the two strokes are totally overlapped, it is determined that the shorter one of the strokes is deleted.

Figure 29A:
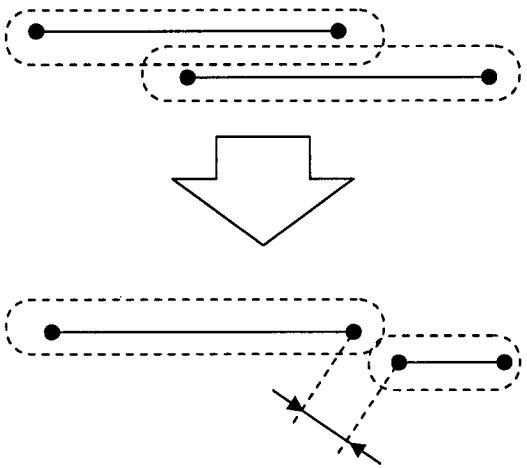
FIGS. 29A and 29B are diagrams illustrating examples of shortening and deleting the parallel strokes.

If it is possible to shorten one of the strokes ("YES" in step S702), the process of shortening one of the strokes is carried out (step S703). That is, if one of the strokes is shifted in the x-axis direction and is sufficiently long to remain even after being shortened as illustrated in FIG. 29A, the process of shortening one of the strokes is carried out. A certain point on one stroke to be divided that has a distance t from an endpoint of the other stroke is computed, and the computed point is determined as a new end point of the former stroke at which the former stroke is divided.

Figure 29B:
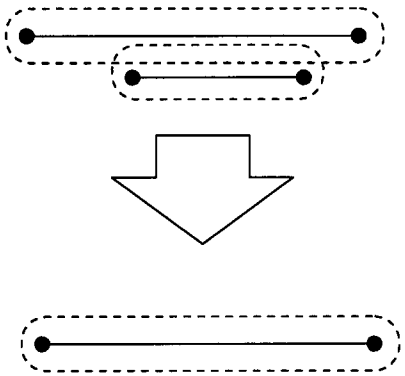

Referring back to FIG. 28, if, on the other hand, it is not possible to shorten one of the strokes ("NO" in step S702), the shorter one of the strokes is deleted (step S704). That is, in a case of an example illustrated in FIG. 29B, since the shorter stroke will not exist without overlapping the longer stroke, the shorter one of the strokes is deleted.

Referring back to FIG. 28, the length of the stroke that has been deleted is computed and the computed length of the stroke is stored (step S705).

Subsequently, the resulting stroke is rotated in an inverse direction based on the aforementioned "sin t" and "cos t" such that the resulting stroke is placed in an original direction (step S706), and the process thereafter is terminated.

Figure 30:
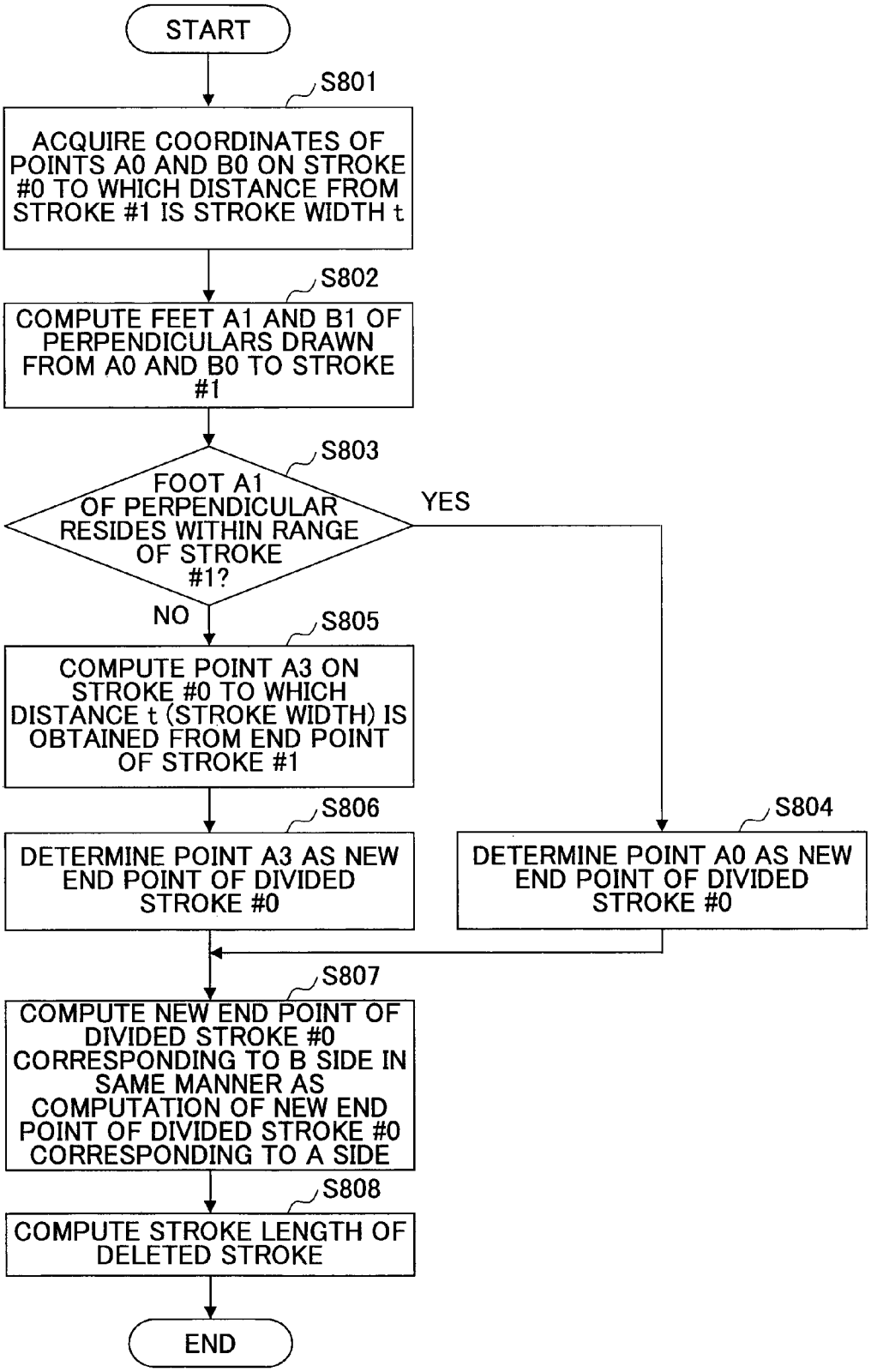
FIG. 30 is a flowchart illustrating an example of a process of dividing the strokes when the strokes are not arranged in parallel with each other.
Figure 31A:
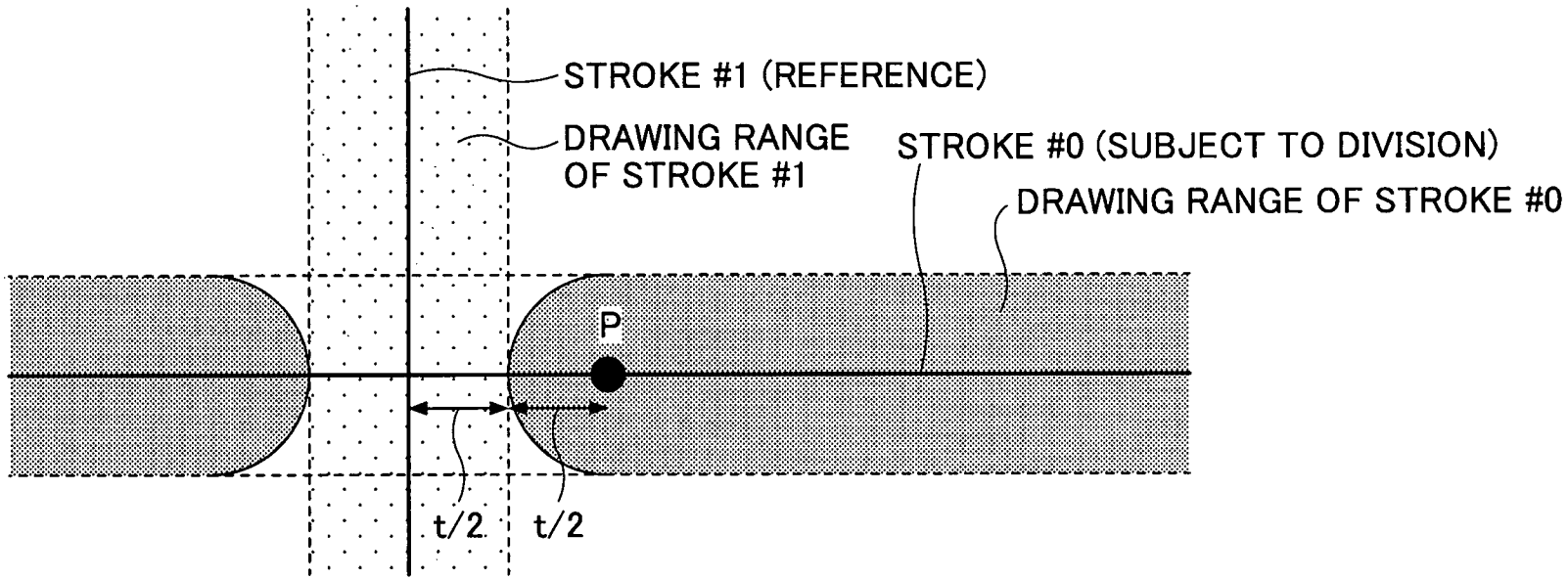
FIGS. 31A and 31B are diagrams illustrating examples of the strokes that intersect each other.
Figure 31B:
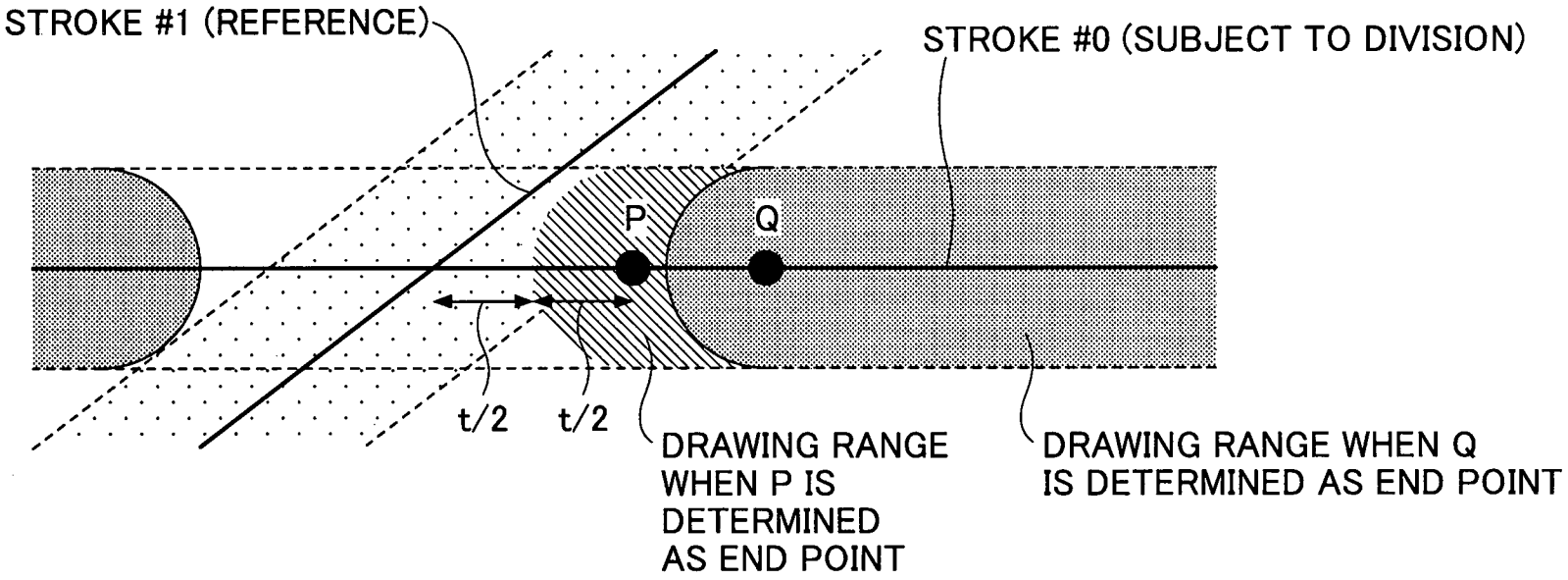

FIG. 30 is a flowchart illustrating an example of a process of dividing the strokes when the strokes are not in parallel with each other (step S507 in FIG. 24). When the end point of the stroke for dividing the stroke is computed, angles of the strokes may need considering as illustrated in FIG. 31B. If the two strokes intersect at right angles as illustrated in FIG. 31A, the stroke may be simply divided by the stroke width. However, if the two strokes intersect diagonally as illustrated in FIG. 31B, the angles of the strokes may need to be considered for computing the end point of the stroke to be divided.

Note that as illustrated in FIGS. 31A and 31B and FIGS. 32A and 32B, two strokes are referred to as a stroke #0 and a stroke #1, and the stroke #0 is divided or shortened based on the stroke #1 (i.e., utilized as a reference stroke).

In FIG. 30, when the process starts, coordinates of a point A0 and coordinates of a point B0 on the stroke #0 to which respective distances from the stroke #1 are the stroke width t are acquired (step S801). More specifically, the following process is carried out.

An equation of a straight line for the stroke #0 (to be divided) is represented by "a0x+b0y+c0=0", an equation of a straight line for the stroke #1 (reference) is represented by "a1x+b1y+c1=0", and a stroke width is "t". Further, a certain point on the stroke #0 that includes a distance t from the stroke #1 is defined as a point P(xp, yp).

Since P is the point on the stroke #0, the following equation (1) may be obtained.

$$a_0x_p+b_0y_p+c_0=0 \tag{1}$$

Since the length (distance) from A0 to the foot of the perpendicular line on the centerline of stroke #1 is "t", the following equation (2) may be obtained based on a point/line distance formula.

$$(a_1x+b_1y_p+c_1)^2=t^2(a_1^2+b_1^2) \tag{2}$$

When the above equations (1) and (2) are solved as simultaneous equations, the strokes #0 and #1 are found to be non-parallel.

That is, the result is expressed by a formula "a1b0−a0b1≠0".

$$x_p=\frac{\pm b_0t\sqrt{a_1^2+b_1^2}+b_1c_0-b_0c_1}{a_1b_0-a_0b_1},\quad y_p=\frac{\pm a_0t\sqrt{a_1^2+b_1^2}-a_1c_0+a_0c_1}{a_1b_0-a_0b_1} \tag{3}$$

(double sign in same order)

Accordingly, the above equations (3) are obtained; one of the equations is the equation for A0 and the other is the equation for B0.

Figure 32A:
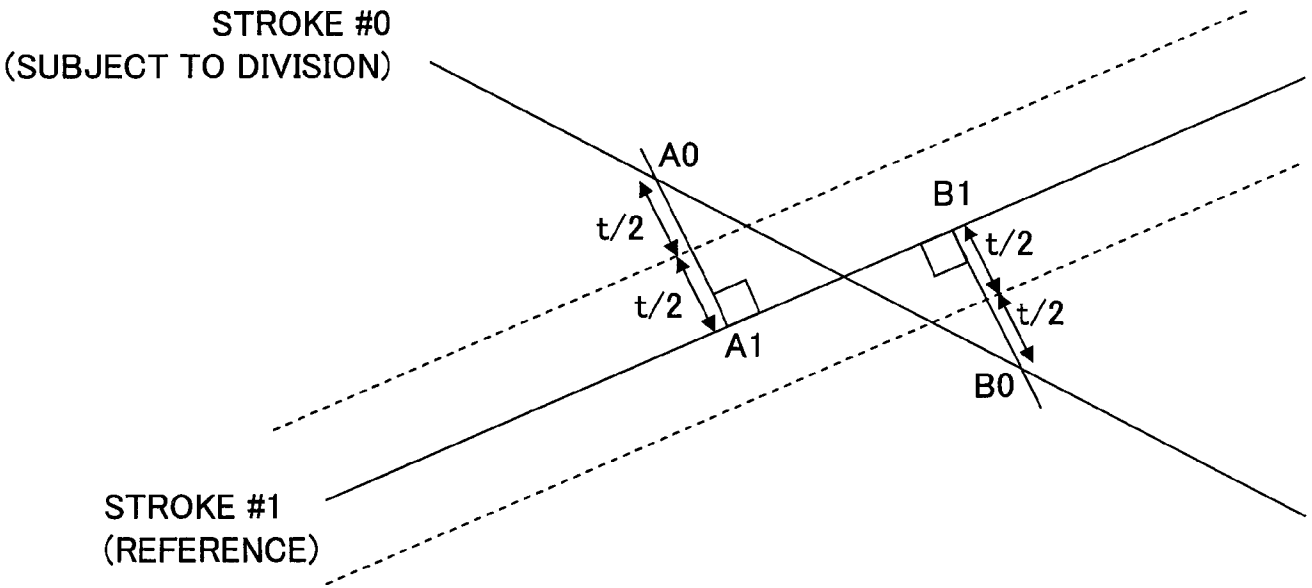
FIGS. 32A and 32B are diagrams illustrating examples of processes when the strokes are not in parallel with each other.

Subsequently, the feet A1 and B1 of the perpendicular lines drawn from the points A0 and B0 perpendicular to the stroke #1 are computed (step S802). FIG. 32A, illustrates an example of this case. In FIG. 32A, the strokes #0 and #1 are illustrated by straight lines and the limitations of the stroke widths are illustrated by broken lines.

More specifically, the following process is carried out.

The foot of the perpendicular line is determined as Q(xq, yq).

If an equation of perpendicular lines is represented by "$a_2x+b_2y+c_2=0$", the perpendicular lines intersect the stroke #1 at right angles. Thus, the equation of the perpendicular lines "a2x+b2y+c2=0" is replaced with the following equation (4).

$$-b_1x+a_1y+c_2=0 \tag{4}$$

Since the above equation (4) illustrates the perpendicular lines that pass through the points A0 and B0, the equation "$-b_1x_p+a_1y_p+c_2=0$" is obtained. Thus, $C_2$ is computed, and the equation (4) is replaced with the following equation (5).

$$-b_1x+a_1y+b_1x_p-a_1y_p=0 \tag{5}$$

Since the intersections of the perpendicular lines with the stroke #1 correspond to the feet of the perpendicular lines, the coordinates (xq, yq) of the feet of the perpendiculars may be obtained by computing (x, y) in the equation (5) and the simultaneous equations of the stroke #1 as illustrated in the equation below.

$$\begin{pmatrix} a_1 & b_1 \\ -b_1 & a_1 \end{pmatrix}\begin{pmatrix} x \\ y \end{pmatrix}+\begin{pmatrix} c_1 \\ b_1x_p-a_1y_p \end{pmatrix}=\begin{pmatrix} 0 \\ 0 \end{pmatrix}$$

Thus, the feet of the perpendicular lines are obtained by computing the following equation (6).

$$\begin{pmatrix} x_q \\ y_q \end{pmatrix}=\frac{-1}{a_1^2+b_1^2}\begin{pmatrix} a_1 & -b_1 \\ b_1 & a_1 \end{pmatrix}\begin{pmatrix} c_1 \\ b_1x_p-a_1y_p \end{pmatrix} \tag{6}$$

Referring back to FIG. 30, whether the foot A1 of the perpendicular line resides within a range of the stroke #1 is determined (step S803). Coordinates of the end points of the stroke #1 are defined as (x1s, y1s) and (x1e, y1e), and coordinates (xq, yq) reside within the range of the coordinates of the end points of the stroke #1.

If the foot A1 of the perpendicular line resides within a range of the stroke #1 ("YES" in step S803), the point A0 will be determined as a new end point of the divided stroke #0 (step S804).

If the foot A1 of the perpendicular line does not reside within a range of the stroke #1 ("NO" in step S803), the point A0 is not appropriate as a new end point of the divided stroke #0. This is because the divided stroke #0 becomes too short. Thus, a point A3 on the stroke #0 to which a distance t (stroke width) is obtained from the end point of the stroke #1 is computed (step S805). More specifically, the following process is carried out.

Coordinates of an end point of the stroke #1 are determined as H(xh, yh). The coordinates of the point A3 are determined as (xr, yr).

Since the point A3 resides on the stroke #0 to be divided, the following equation (7) is obtained.

$$a_0x_r+b_0yr+c_0=0 \tag{7}$$

Further, since a distance between the point A3 and the coordinates H(xh, yh) is t, the following equation (8) is obtained.

$$(x_r-x_h)^2+(y_r-y_h)^2=t^2 \tag{8}$$

When the above equations (7) and (8) are solved as simultaneous equations, the coordinates (xr, yr) of the point A3 are computed.

Further, the following equations are determined:

$$c_a=a_0^2+b_0^2$$

$$c_b=-b_0^2x_h+a_0b_0y_n+a_0c_0$$

$$c_c=b_0^2(x_b^2-_t^2)+(b_0y_h+c_0)^2$$

In addition, the following equation is determined.

$$c_d=\sqrt{c_b^2-c_ac_c}$$

In the above conditions, if $b_0\neq 0$, the following equation is obtained.

$$x_r=\frac{-c_b\pm c_d}{c_a}$$

The following equation may be computed by applying the computed xr.

$$y_r=-\frac{a_0x_r+c_0}{b_0}$$

If $b_0\neq 0$, $a_0\neq 0$. Accordingly, the following equation is obtained.

$$x_r=-\frac{c_0}{a_0},\ y_r=y_h+\sqrt{t^2-\left(x_h+\frac{c_0}{a_0}\right)^2}$$

Figure 32B:
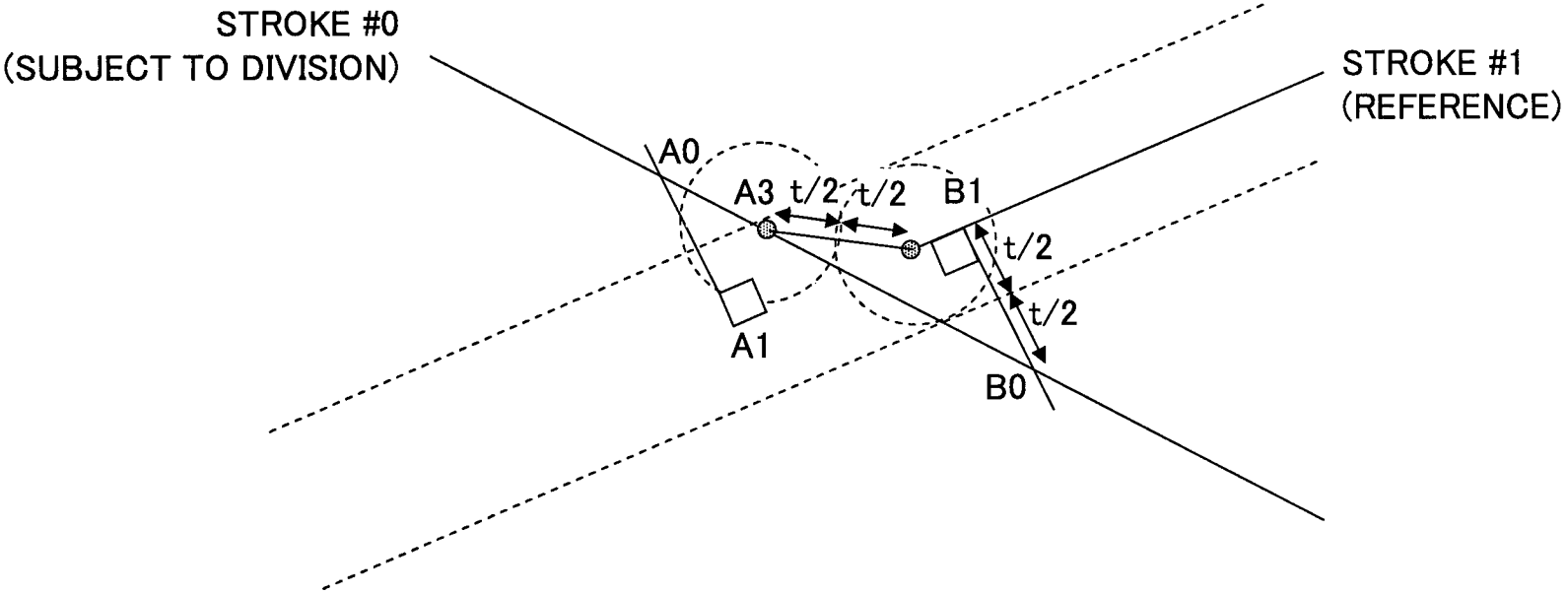

Thus, the point A3 (i.e., the computed coordinates (xr, yr)) is determined as a new end point of the divided stroke #0 (step S806). FIG. 32B illustrates an example of this case.

Referring back to FIG. 30, a new end point of the divided stroke #0 corresponding to a B side is computed in the same manner as an A side (step S807), the stroke length of the deleted stroke is computed (step S808), and the process of dividing the stroke is terminated.

Figure 33:
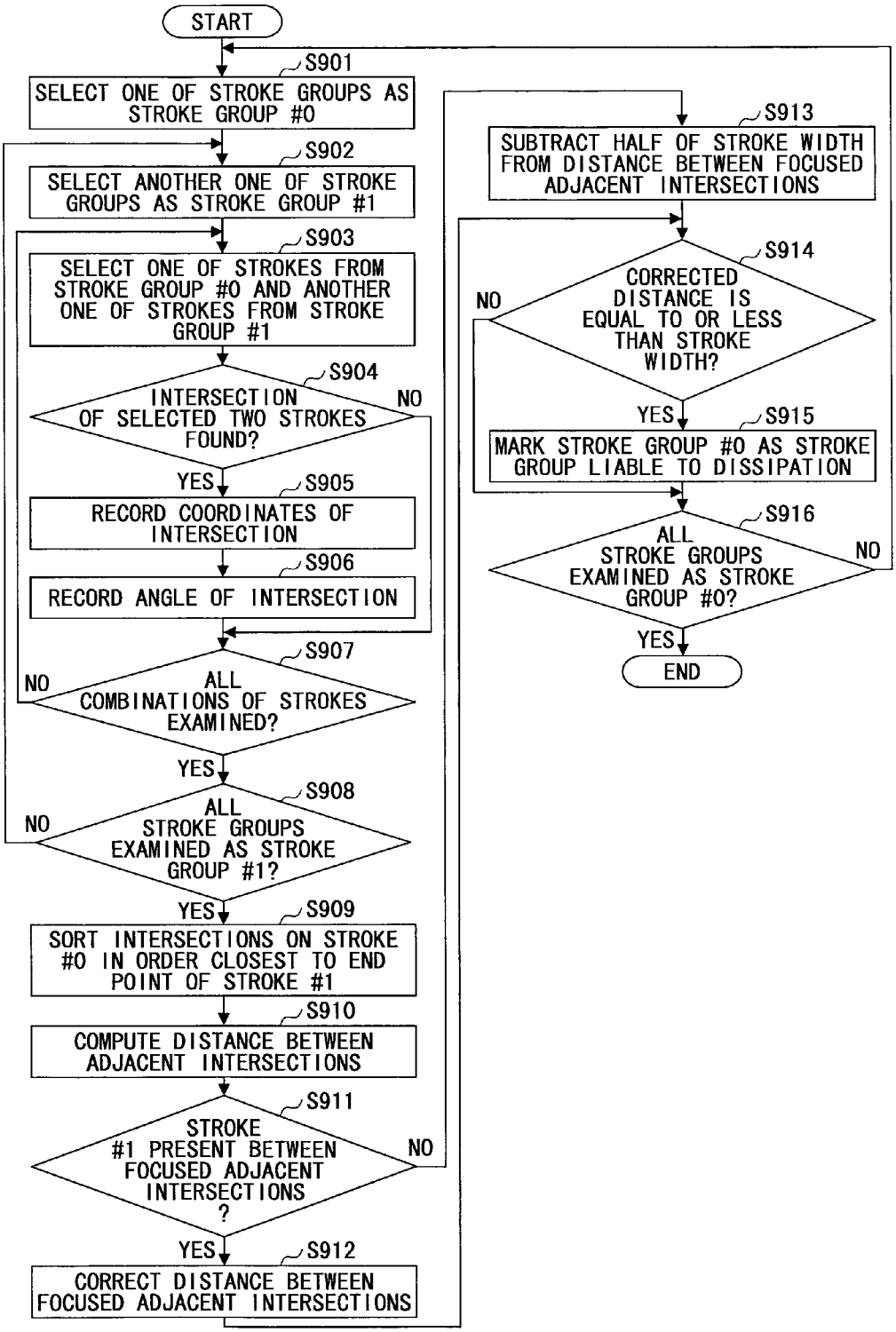
FIG. 33 is a flowchart illustrating an example of a process of assigning a mark to the stroke that is liable to dissipation.

FIG. 33 is a flowchart illustrating an example of a process of marking the stroke liable to dissipation (step S209 in FIG. 18).

In FIG. 33, when the process starts, one of the stroke groups is selected as a stroke group #0 (step S901), and another one of the stroke groups is then selected as a stroke group #1 (step S902). Subsequently, one of the strokes is selected from the stroke group #0 and another one of the strokes is selected from the stroke group #1 (step S903). Thereafter, whether there is an intersection of the selected two strokes is determined (step S904).

If there is the intersection of the two strokes ("YES" in step S904), coordinates of the intersection and an angle of the intersection of the two strokes are stored in an intersection array (intersection array data) by associating the coordinates of the intersection and the angle of the intersection of the two strokes with the stroke group #0 (steps S905 and S906). If there is no intersection of the two strokes ("NO" in step S904), no process is carried out.

Subsequently, whether all the combinations of the strokes have been examined is determined (step S907). If not all the combinations of the strokes have been examined ("NO" in step S907), the process of selecting a combination of two strokes in step S903 is carried out (back to step S903).

If all the combinations of the strokes have been examined ("YES" in step S907), whether all the stroke groups have been examined as the stroke group #1 is determined (step S908). If not all the stroke groups have been examined ("NO" in step S907), the process of selecting another one of the stroke groups as the stroke #1 in step S902 is carried out (back to step S902).

If, on the other hand, all the stroke groups have been examined as the stroke group #1 ("YES" in step S908), a group of coordinates of the intersection of the acquired stroke group #0 is sorted in the order from the closest to the start point of the stroke group #1 (step S909).

Subsequently, a distance between the adjacent intersections is computed (step S910).

Figure 34A:
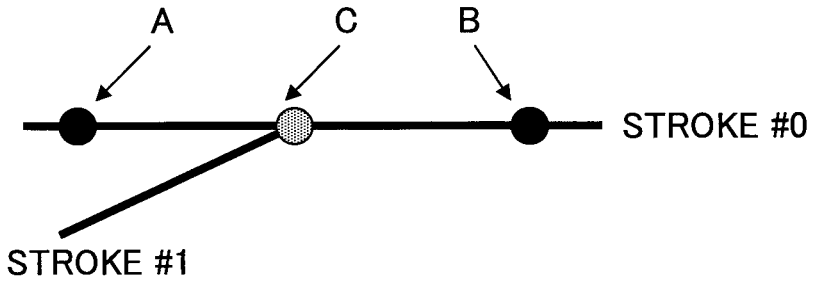
FIGS. 34A and 34B are diagrams illustrating examples when a distance between the intersections is corrected based on an angle of intersection of the strokes.

Subsequently, whether the stroke #1 is present between the adjacent intersections is determined, focusing on one interval between the adjacent intersections (step S911). FIG. 34A illustrates an example in which an intersection C of the stroke #1 and the stroke #0 is present at a midpoint between the adjacent intersections A and B on the stroke #0. In this example, when an interval between the adjacent intersections A and C is focused on, the stroke #1 is sloped in a lower left direction. Thus, it is determined that the stroke #1 is not present between the adjacent intersections C and B, but is present between the focused on adjacent intersections A and C.

Figure 34B:
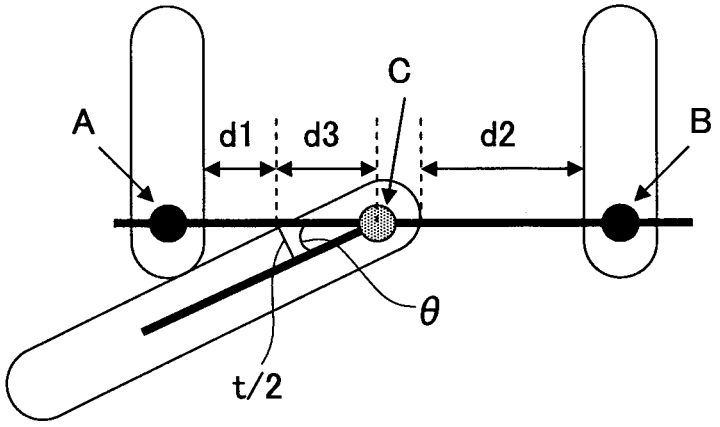

Referring back to FIG. 33, if the stroke #1 is present between the focused on adjacent intersections A and C ("YES" in step S911), the distance between the focused on adjacent intersections A and C is corrected by adjusting the angle of the intersection of the two strokes #0 and #1 (step S912). In the example illustrated in FIG. 34A, a distance between the intersection C with the stroke #1 and the intersection A with another stroke is equal to a distance between the intersection C with the stroke #1 and the intersection B with another stroke on the stroke #0. However, each of the strokes has a stroke width, a practical distance d1 between the intersections C and A (A side distance) is less than a practical distance d2 between the intersections C and B (B side distance) as illustrated in FIG. 34B. If the practical distance d1 between the intersections A and C is 0, the stroke present at the interval between the intersections A and C is liable to dissipation. Thus, it is important to correct the practical distance d1 by adjusting the angle of the intersection of the strokes #0 and #1. If the computed distance between the adjacent intersections is the A side distance, the A side distance is corrected by adjusting the angle of the intersection. Specifically, the A side distance is corrected by subtracting a distance d3 from the original distance between the adjacent intersections, and thus, if the angle of the intersection is θ and the stroke width is T, the distance d3 is computed by the following equation.

$$d3 = t/2 \sin \theta$$

Referring back to FIG. 33, if the stroke #1 is not present between the focused on adjacent intersections ("NO" in step S911), half of the stroke width, that is, t/2 is subtracted from the distance between the focused on adjacent intersections (step S913). This process is carried out on the practical distance d2 between the focused on adjacent intersections C and B illustrated in FIG. 34B.

Referring back to FIG. 33, whether the corrected distance is equal to or less than the stroke width is determined (step S914).

If the corrected distance between the focused on adjacent intersections is equal to or less than the stroke width ("YES" in step S914), and the stroke #0 is divided at both intersections, no stroke is drawn between the focused on adjacent intersections. Accordingly, it is determined that the stroke #0 is liable to dissipation, and hence, the stroke group #0 is marked as the stroke group liable to dissipation (step S915). If, on the other hand, the corrected distance between the focused on adjacent intersections is greater than the stroke width ("NO" in step S914), the stroke group #0 is unmarked.

Subsequently, whether all the stroke groups are examined as the stroke group #0 is determined (step S916). If not all the stroke groups have been examined as the stroke group #0 ("NO" in step S916), the process of selecting one of stroke groups as the stroke group #0 in step S901 is carried out (back to step S901). If, on the other hand, all the stroke groups have been examined as the stroke group #0 ("YES" in step S916), the process of marking the stroke liable to dissipation is terminated.

Figure 35:
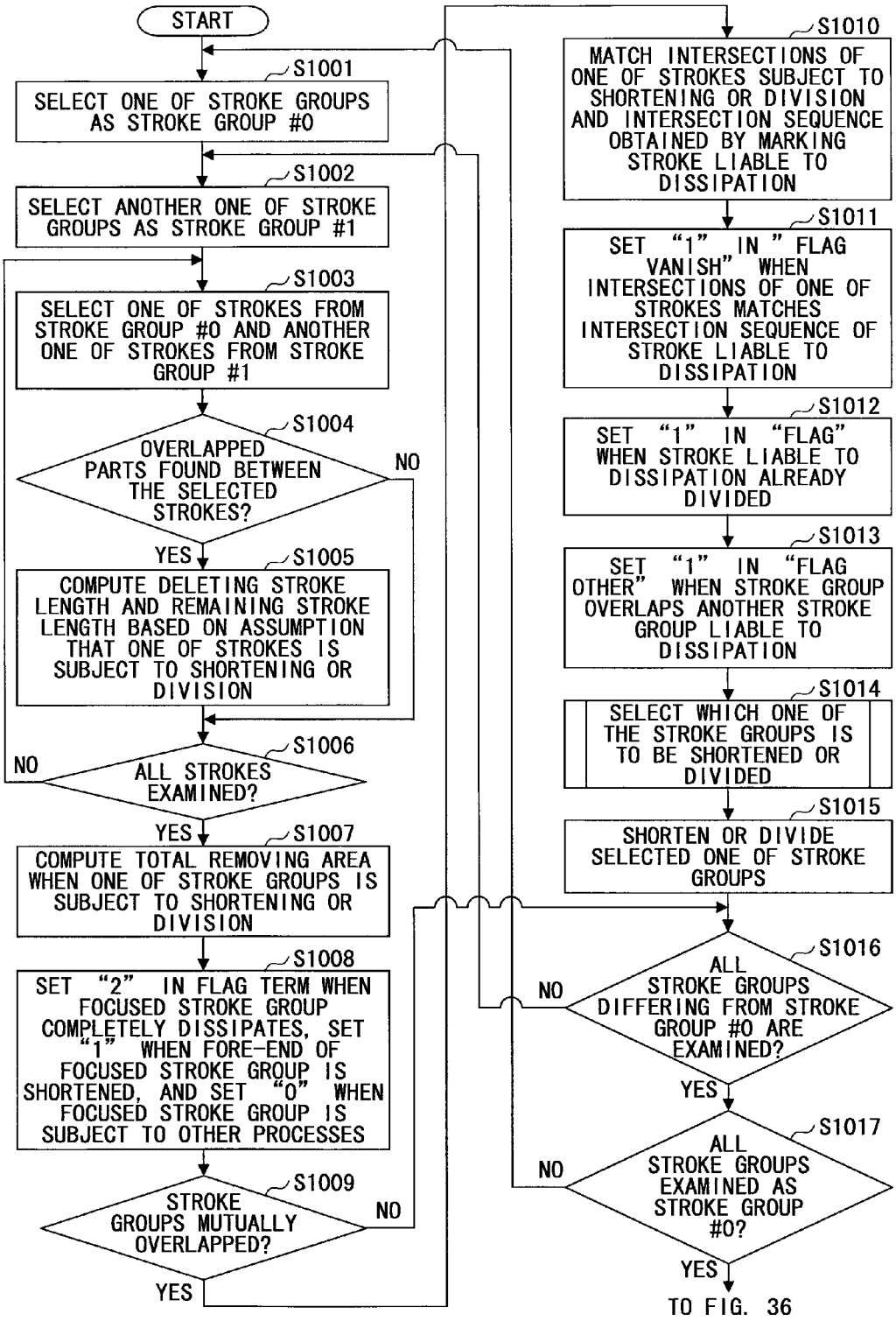
FIG. 35 is a flowchart illustrating an example of a process of removing an overlapped part of the strokes between stroke groups.
Figure 36:
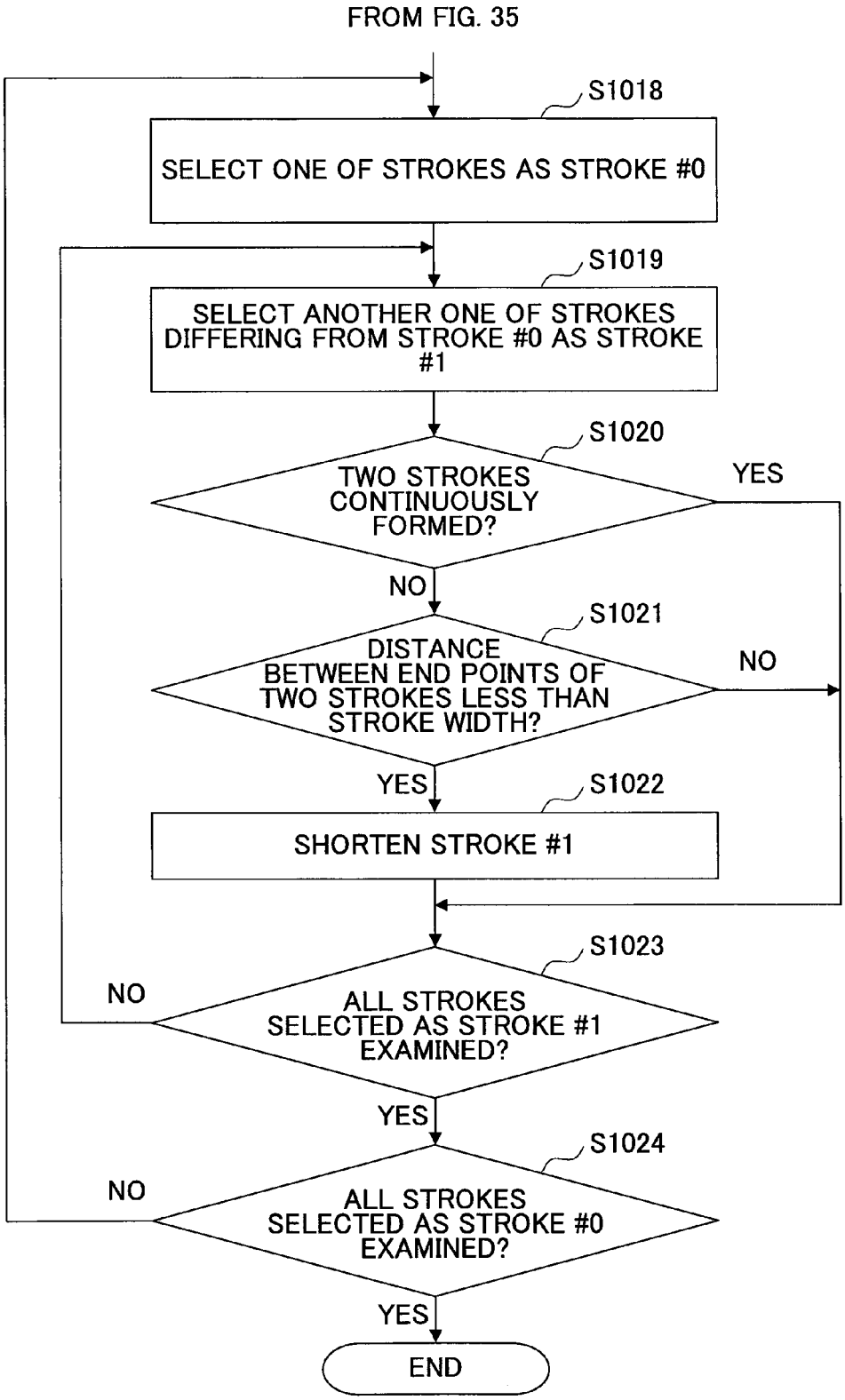
FIG. 36 is a flowchart illustrating another example of a process of removing an overlapped part of the strokes between stroke groups.

FIGS. 35 and 36 are flowcharts illustrating an example of a process of removing an overlapped part of the strokes between the stroke groups (step S210 in FIG. 18).

In FIG. 35, when the process of removing an overlapped part of the strokes between the stroke group starts, one of the stroke groups is selected as the stroke group #0 and another one of the stroke groups is selected as the stroke group #1 (steps S1001 and S1002).

Subsequently, one of the strokes is selected from the stroke group #0 and another one of the strokes is selected from the stroke group #1 (step S1003).

Subsequently, whether the selected two strokes include an overlapped part is determined (step S1004).

If there is an overlapped part between the two strokes ("YES" in step S1004), a deleting stroke length and a remaining stroke length are computed based on the assumption that one of the strokes is subject to shortening or division (step S1005). This process is similar to the flowchart illustrated in FIG. 24.

Referring back to FIG. 35, if, on the other hand, there is no overlapped part between the two strokes ("NO" in step S1004), the process of computing the deleting stroke length and the remaining stroke length (step S1005) is not carried out.

Subsequently, whether all the strokes associated with the stroke groups #0 and #1 are examined is determined (step S1006). If not all the strokes associated with the stroke groups #0 and #1 have been examined ("NO" in step S1006), the process of selecting one of the strokes from the stroke group #0 and another one from the stroke group #1 in step S1003 is carried out (back to step S1003).

If it is determined that all the strokes associated with the stroke groups #0 and #1 have been examined ("YES" in step S1006), a total removing area when one of the stroke groups is shortened or divided is computed (step S1007). The total removing area may be obtained by multiplying the deleting stroke length by the stroke width.

Subsequently, if one of the strokes is subject to shortening or division, "2" is set in the "flag term" when the focused on stroke group completely dissipates, "1" is set in the "flag term" when a fore-end part of the focused on stroke group is shortened, and "0" is set in the "flag term" when the focused on stroke group is subject to other processes (step. S1008).

Subsequently, whether the two stroke groups (stroke groups #0 and #1) are mutually overlapped is determined (step S1009).

If the two stroke groups are not mutually overlapped ("NO" in step S1009), the following processes (steps S1010 to S1015) are skipped (omitted).

If the two stroke groups are mutually overlapped ("YES" in step S1009), intersections of one of the stroke groups subject to shortening or division and a sequence of intersections obtained by marking the stroke liable to dissipation (process in FIG. 33) are matched (step S1010).

Subsequently, if the intersections of one of the stroke groups subject to shortening or division and the intersection sequence of the stroke liable to dissipation are matched, "1" is set in the "flag vanish" (step S1011).

Subsequently, if the stroke liable to dissipation has already been divided, "1" is set in the "flag" (step S1012).

Subsequently, if the stroke group overlaps another stroke group that may be liable to dissipation, "1" is set in the "flag other" (step S1013). Whether another stroke group is liable to dissipation is determined based on the dissipation liability mark provided in the process illustrated in FIG. 33.

Referring back to FIG. 35, which one of the stroke groups is to be shortened or divided is selected (step S1014). Details of the process of selecting which one of the stroke groups is to be shortened or divided will be described later.

Subsequently, the selected one of the stroke groups is shortened or divided based on the data computed in advance (step S1015).

Subsequently, whether all the stroke groups differing from the stroke group #0 have been examined is determined (step S1016). If not all the stroke groups differing from the stroke group #0 have been examined ("NO" in step S1016), the process of selecting one of the strokes as the stroke group #1 in step S1002 is carried out (back to step S1002).

If all the stroke groups differing from the stroke group #0 have been examined ("YES" in step S1016), whether all the stroke groups have been examined as the stroke group #0 is determined (step S1017). If not all the stroke groups have been examined as the stroke #0 ("NO" in step S1017), the process of selecting one of the stroke groups in step S1001 is carried out (back to step S1001).

Figure 37B:
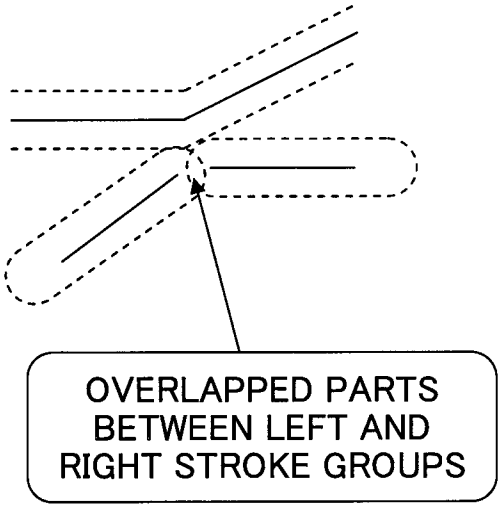
FIGS. 37A and 37B are diagrams illustrating examples of the strokes that are brought into slight contact with each other.
Figure 37A:
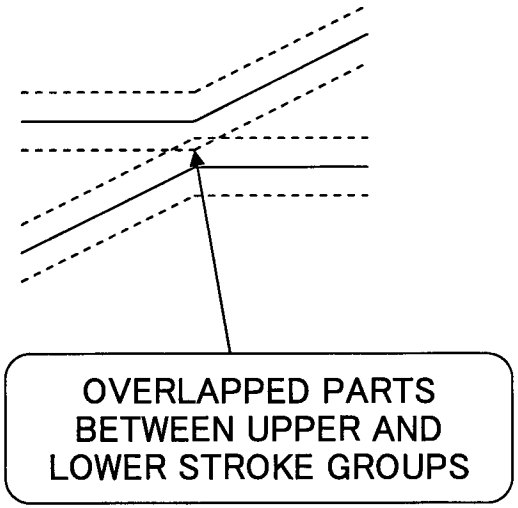

If, on the other hand, all the stroke groups have been examined as the stroke group #0 is determined ("YES" in step S1017), the process of determining whether there is an overlapped part between the selected strokes and shortening of the selected one of the stroke groups is carried out. That is, if the stroke that is slightly in contact with another stroke is divided, a distance between an end point of the stroke and an end point of the other stroke may be less than the stroke width. In such a case, the overlapped part may remain between the two stroke groups, and hence the two stroke groups are further examined to be shortened. For example, when the overlapped part between the upper and lower stroke groups illustrated in FIG. 37A is removed by dividing the lower stroke group, a new overlapped part is formed between the divided strokes of the lower stroke group as illustrated in FIG. 37B.

In this case, the divided strokes of the lower stroke group may need to be shortened.

In FIG. 36, one of the strokes is selected from the stroke groups subject to shortening or division selected in step S1014 as the stroke #0 (step S1018), and one of the strokes is selected from the stroke groups subject to shortening or division selected in step S1014 as the stroke #1, likewise (step S1019).

Subsequently, whether the selected combinations of the strokes #0 and #1 are continuously formed is determined (step S1020). If the selected combinations of the strokes #0 and #1 are not continuously formed ("NO" in step S1020), whether a distance between the endpoints of the stroke #0 and #1 is less than the stroke width is further determined (step S1021).

If, on the other hand, the distance between the endpoints of the stroke #0 and #1 is less than the stroke width ("YES" in step S1021), the stroke #1 is shortened (step S1022).

If the selected combinations of the strokes #0 and #1 are continuously formed ("YES" in step S1020), and the distance between the endpoints of the stroke #0 and #1 is not less than the stroke width ("NO" in step S1021), the process of shortening the stroke #1 (step S1022) is not carried out.

Subsequently, whether all the strokes selected as the stroke #1 have been examined is determined (step S1023). If not all the strokes selected as stroke #1 have been examined ("NO" in step S1023), the process of selecting one of the strokes from the stroke groups subject to shortening or division selected as the stroke #1 in step S1019 is carried out (back to step S1019).

If all the strokes selected as the stroke #1 have been examined ("YES" in step S1023), whether all the strokes selected as the stroke #0 have been examined is determined (step S1024). If not all the strokes selected as the stroke #0 have been examined ("NO" in step S1024), the process of selecting one of the strokes from the stroke groups subject to shortening or division selected as the stroke #0 in step S1018 is carried out (back to step S1018).

If, on the other hand, all the strokes selected as the stroke #0 have been examined ("YES" in step S1024), the process is terminated.

Figure 38A:
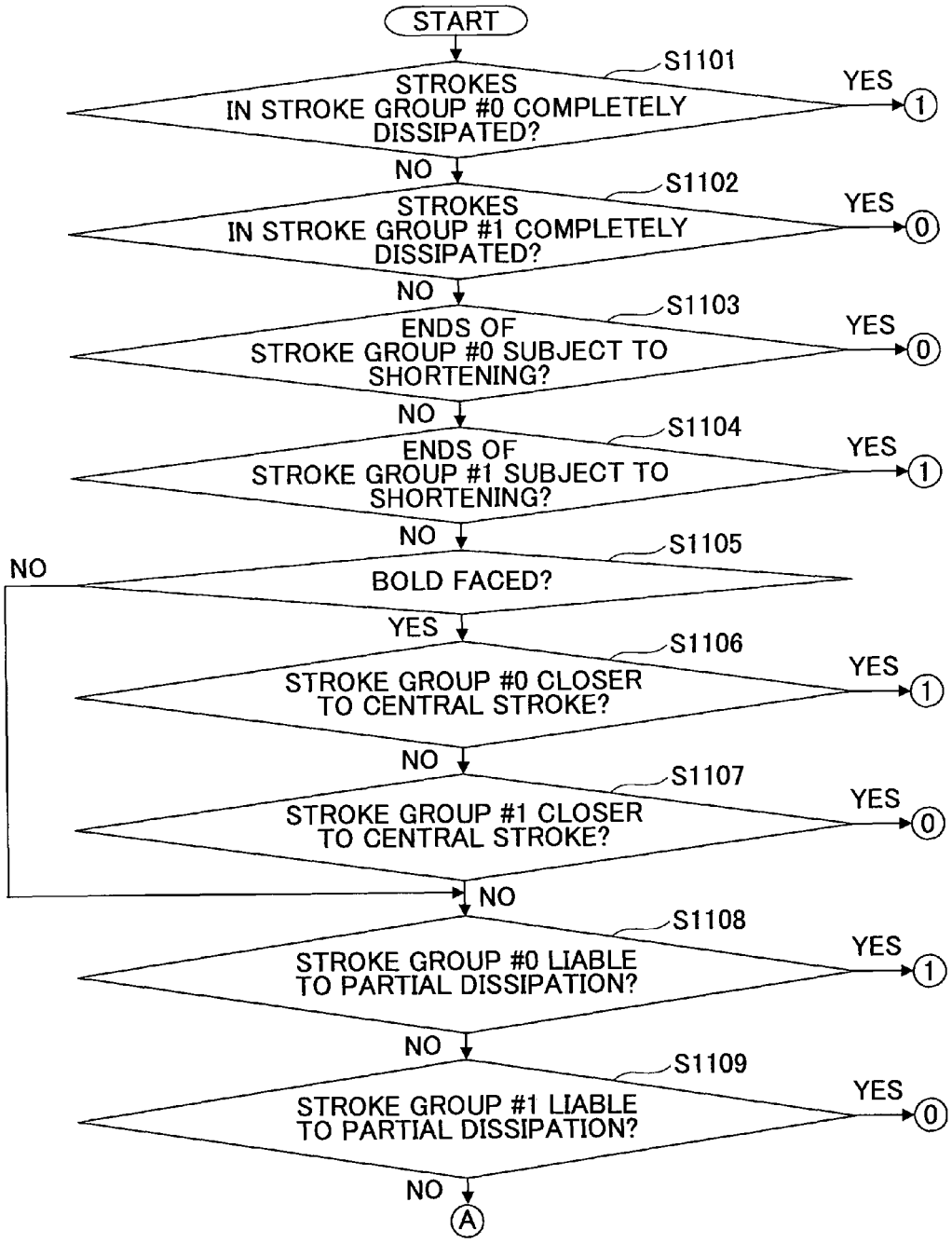
FIGS. 38A and 38B are flowcharts illustrating an example of a process of selecting one of the stroke groups as the stroke group subject to shortening or division.
Figure 38B:
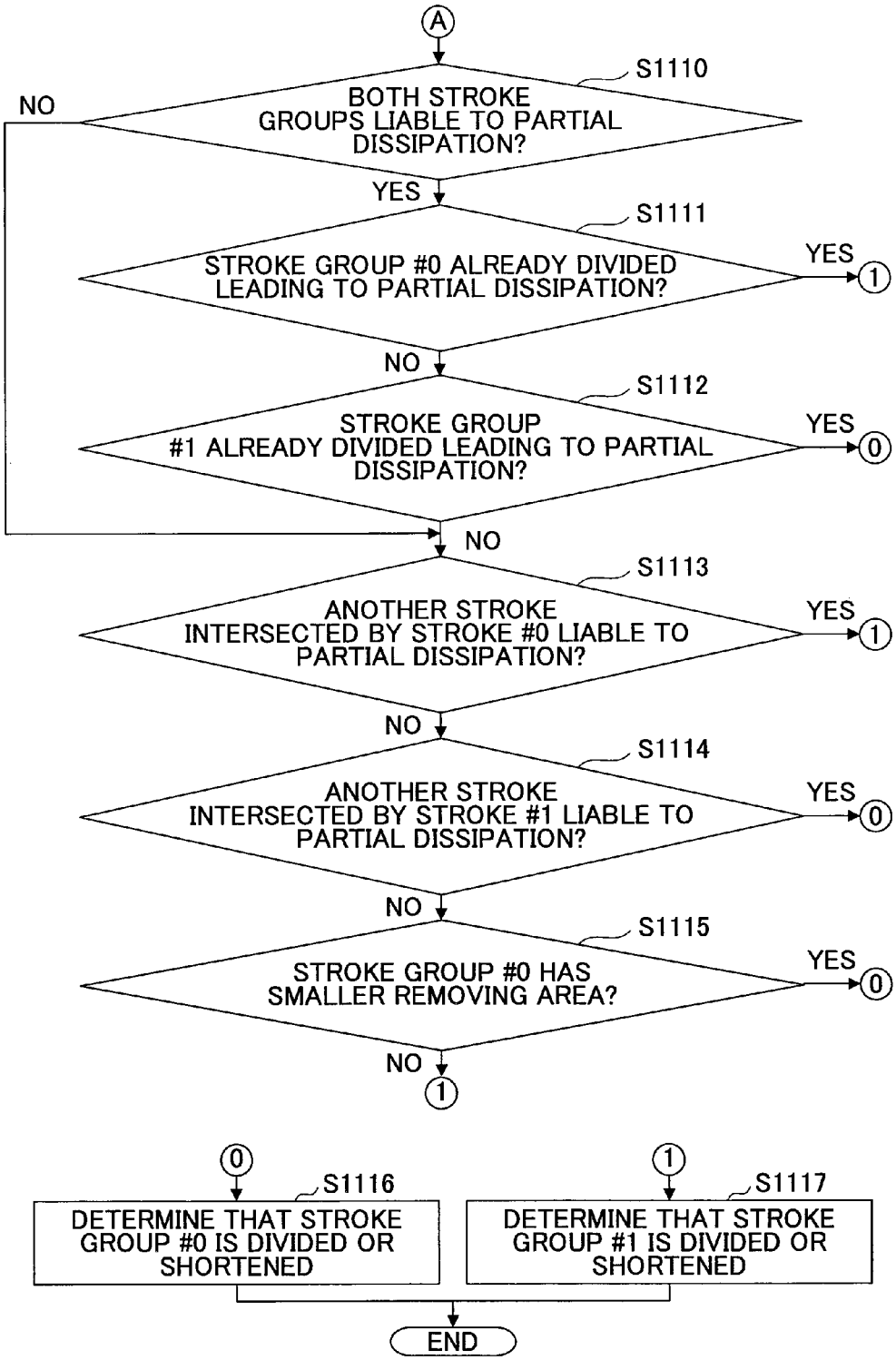

FIGS. 38A and 38B are a flowchart illustrating an example of a process of selecting one of stroke groups as the stroke group subject to shortening or division (step S1014 in FIG. 35).

In FIGS. 38A and 38B, when the process of selecting one of the stroke groups subject to shortening or division starts, whether all the strokes in the stroke group #0 have completely dissipated is determined (step S1101). If it is determined, based on the flag "term", that all the strokes in the stroke group #0 have dissipated and no stroke remains in the stroke group #0 ("YES" in step S1101), the strokes of the stroke group #1 are divided or shortened (step S1117).

By contrast, if it is determined, based on the flag "term", that the stroke group #0 has remaining strokes ("YES" in step S1102), the strokes of the stroke group #0 are divided or shortened (step S1116).

If ends of the stroke group #0 are subject to shortening ("YES" in step S1103), the stroke group #0 is shortened (S1116). The process of shortening the stroke group #0 is carried out in this case because shortening the stroke group #0 may less adversely affect the appearance of the desired character to be drawn than dividing the stroke group #0.

If, on the other hand, ends of the stroke group #1 are subject to shortening ("YES" in step S1104), the stroke group #1 is shortened (step S1117).

Figure 39A:
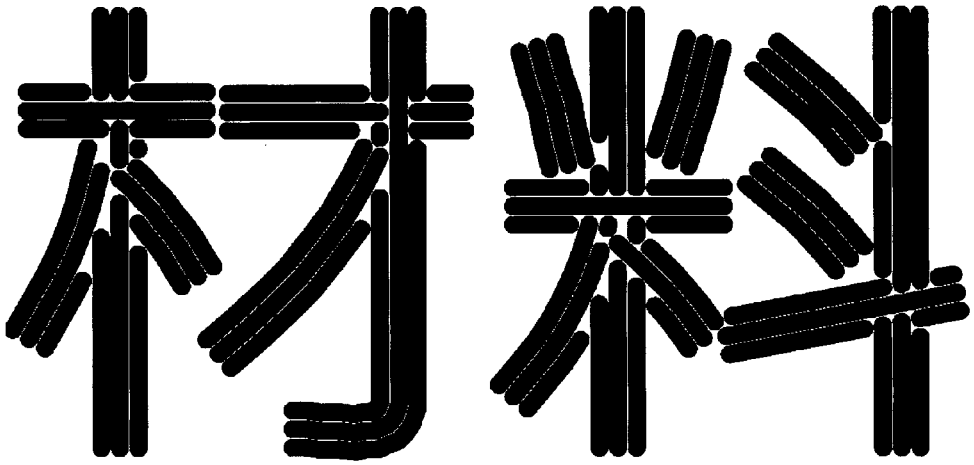
FIGS. 39A and 39B are drawing examples of bold-faced characters.
Figure 39B:
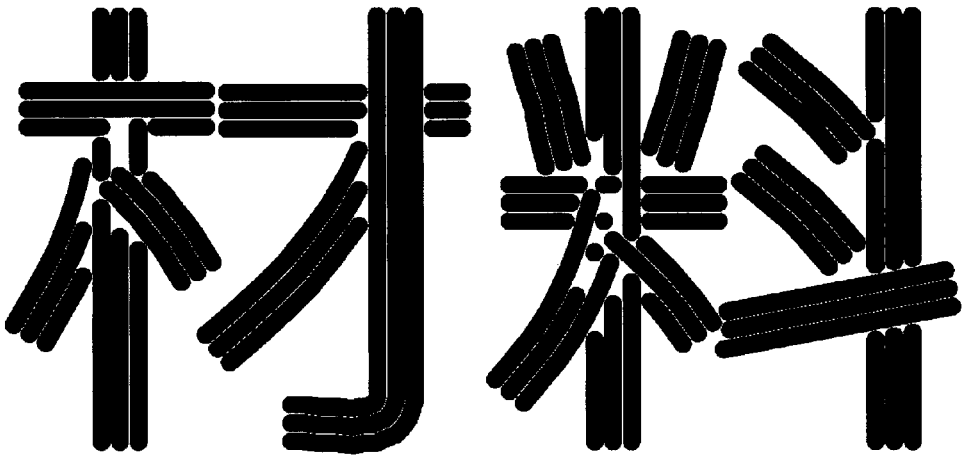

If the desired character to be drawn is bold faced ("YES" in step S1105), and the stroke group #0 is closer to the central stroke ("YES" in step S1106), the stroke group #1 is divided or shortened (step S1117). The shortening or dividing of the stroke group #1 in this case is selected because leaving the strokes closer to the central stroke may give better appearance of the desired character to be drawn than shortening or dividing the stroke group #0. FIGS. 39A and 39B illustrate drawing examples of the bold-faced desired characters, where FIG. 39A is the drawing example that does not require leaving the strokes closer to the central stroke and FIG. 39B is the drawing example that requires leaving the strokes closer to the central stroke.

Referring back to FIGS. 38A and 38B, if the stroke group #1 is closer to the central stroke than the stroke group #0, the stroke group #0 is divided or shortened (step S1116).

Subsequently, if it is determined, based on the flag "vanish", that the stroke group #0 is liable to partial dissipation ("YES" in step S1108), the stroke group #1 is divided or shortened (step S1117).

If, on the other hand, it is determined, based on the flag "vanish", that the stroke group #1 is liable to partial dissipation ("YES" in step S1109), the stroke group #0 is shortened (step S1116).

If it is determined, based on the flag "vanish", that the stroke group #0 and the stroke group #1 are both liable to partial dissipation ("YES" in step S1110), it is determined whether the stroke group #0 or the stroke group #1 has already been divided, which may have led to the partial dissipation of the stroke groups #0 or #1. This corresponds to a case in which a distance between the adjacent strokes, one of which has been already divided at its intersection, is less than the stroke width in a certain stroke group. In this case, if the other one of the adjacent strokes is also divided at its intersection, the stroke sandwiched between the intersections of the two adjacent strokes is liable to dissipation.

Thus, if the stroke group #0 has already been divided ("YES" in step S1111), the stroke group #1 is divided or shortened (S1117).

If, on the other hand, the stroke group #1 has already been divided ("YES" in step S1112), the stroke group #0 is divided or shortened (step S1116).

Subsequently, if it is determined, based on the flag "other", that the stroke group #0 alone intersects another stroke such that the stroke intersected by the stroke group #0 is liable to partial dissipation ("YES" in step S1113), the stroke group #1 is determined as the stroke group subject to division (step S1117). The stroke group #1 is determined as the stroke group subject to division because the stroke group #0 may have a sufficient length for being divided or shortened in future so as not to allow another stroke intersected by the stroke group #0 to dissipate.

If, on the other hand, it is determined, based on the flag "other", that another stroke intersected by the stroke group #1 is liable to partial dissipation ("YES" in step S1114), the stroke group #0 is divided or shortened (step S1116).

Subsequently, respective removing areas of the stroke groups #0 and #1 are compared. If the removing area of the stroke group #0 is smaller than that of the stroke group #1 ("YES" in step S1115), the stroke group #0 is divided or shortened (step S1116).

If, on the other hand, the removing area of the stroke group #1 is smaller that that of the stroke group #0 ("NO" in step S1115), the stroke group #1 is divided or shortened (step S1117).

Figure 3A:
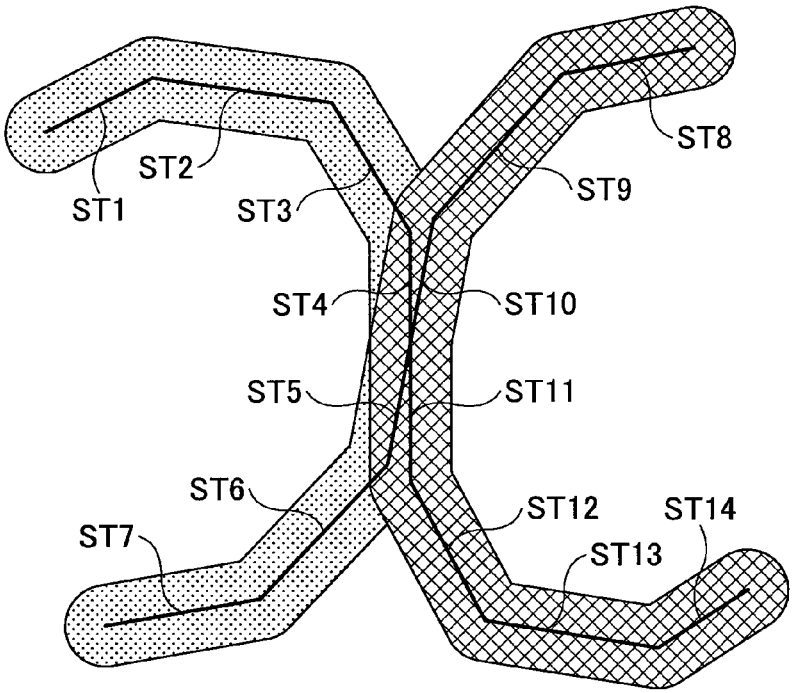
FIGS. 3A and 3B are diagrams illustrating an example of a character formed of strokes and the character of the strokes that result in disconnection or fragmentation.
Figure 3B:
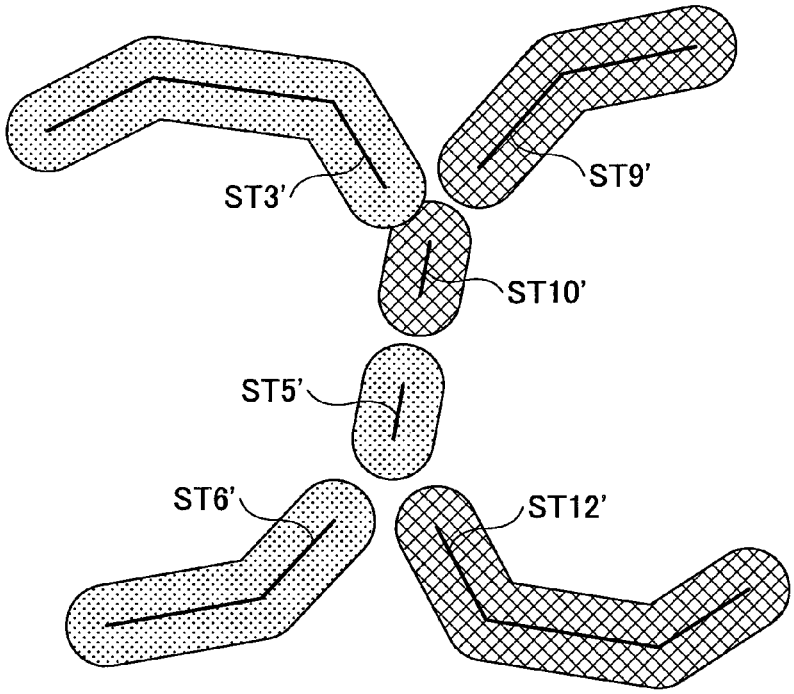
Figure 4:
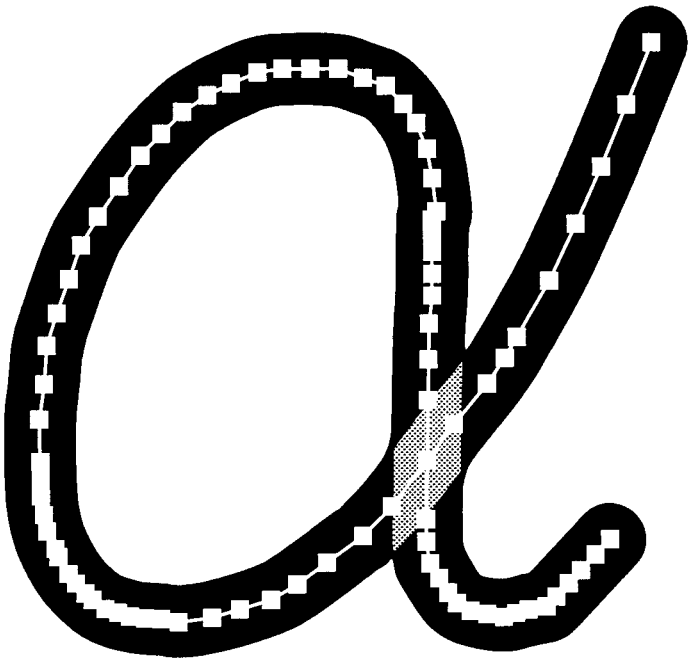
FIG. 4 is a diagram illustrating another example of a character formed of strokes and the character of the strokes that result in disconnection or fragmentation.
Figure 40A:
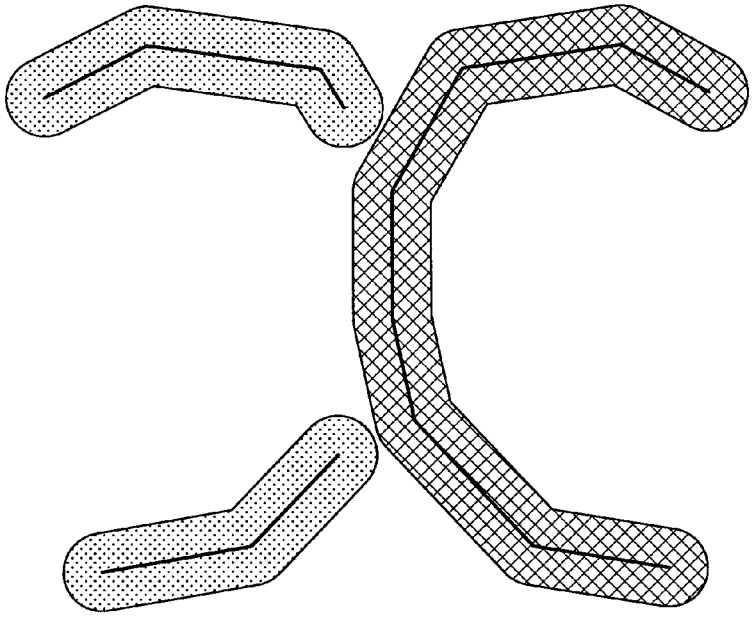
FIGS. 40A and 40B are diagrams illustrating examples in which degradation of appearance of desired characters due to the limitations and disadvantages of the related art have been improved.
Figure 40B:
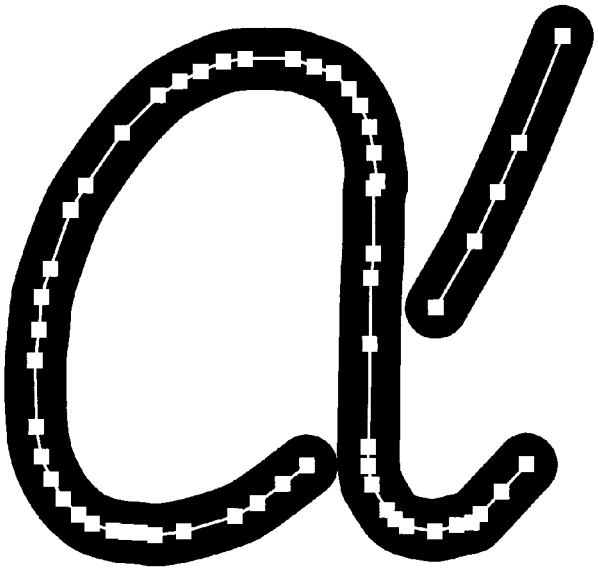

FIGS. 40A and 40B are diagrams illustrating examples in which the degradation and disconnection of the desired characters caused by the limitations and disadvantages of the related art have been improved. That is, in the related art as illustrated in FIG. 3B, two or more mutually approaching strokes may be fragmented, which may result in degradation of drawing quality. However, according to the above-described embodiments, the overlapped part between the strokes forming the desired character is removed per stroke group. Accordingly, mutually approaching parts of the strokes are not disconnected, which may prevent the appearance of the desired character from being degraded.

Further, according to the above-described embodiments, an overlapped part is present between the strokes within the same stroke group, such as a character "a". In this case, the overlapped part of the strokes formed of the desired character is removed in a similar manner as removing the overlapped part of the strokes in the arranged order of strokes in the same stroke group and then those in another stroke group. Accordingly, mutually approaching parts of the strokes in one stroke group are not disconnected, which may prevent the appearance of the desired character from being degraded.

According to the above-described embodiments, even if two or more mutually approaching (proximate) strokes form the character, the apparatus, method and computer readable medium storing a program for drawing an image on a thermal rewritable medium may be capable of drawing a character on the thermal rewritable medium without degradation of image quality due to disconnection of the two or more proximate strokes forming the character. Accordingly, the degradation of drawing quality of the character may be prevented.

[Overview]

As described above, according to the above-described embodiments, even if two or more mutually approaching (proximate) strokes form the character, it may be possible to draw an image formed of the two or more strokes on the thermal rewritable medium without degradation of image quality due to disconnection of the two or more proximate strokes forming the character. Accordingly, the degradation of drawing quality of the character may be prevented.

The advantages illustrated above are merely examples of the most preferred ones provided by the embodiments, and therefore are not limited to those described in the embodiments.

Embodiments of the present invention have been described heretofore for the purpose of illustration. The present invention is not limited to these embodiments, but various variations and alterations may be made without departing from the scope of the present invention. The present invention should not be interpreted as being limited to the embodiments that are described in the specification and illustrated in the drawings.

The present application is based on Japanese Priority Application No. 2010-261771 filed on Nov. 24, 2010 and Japanese Priority Application No. 2011-046861 filed on Mar. 3, 2011, with the Japanese Patent Office, the entire contents of which are hereby incorporated by reference.

The invention claimed is:

1. An apparatus for drawing an image on a thermal medium, the apparatus comprising:

a stroke group generating unit configured to group continuous strokes forming the image of a desired character to be drawn to generate one or more stroke groups of the continuous strokes, each stroke within each stroke group having at least one endpoint in common with at least one other stroke in the respective stroke group;

a first overlapped part removing unit configured to detect a first overlapped part between a first combination of the strokes associated with the same stroke group to remove the first overlapped part in an arranged order of the strokes within the same stroke group; and a second overlapped part removing unit configured to detect a second overlapped part between a second combination of the strokes associated with plural of the stroke groups to remove the second overlapped part from the stroke groups.

2. The apparatus according to claim 1, wherein the stroke group associated with the first combination of the strokes is a first stroke group, the second combination of strokes forms a second stroke group, the first overlapped part removing unit removes the first overlapped part in the arranged order of the strokes within the first stroke group, and the second overlapped part removing unit removes the second overlapped part between the first and second stroke groups.

3. The apparatus according to claim 1, further comprising a stroke group marking unit configured to mark a stroke group as liable to dissipation based on the first overlapped part of the strokes within the stroke group removed by the first overlapped part removing unit, wherein the second overlapped part removing unit determines which strokes of the strokes associated with plural stroke groups are to be modified based on which of the plural stroke groups were marked as liable to dissipation by the stroke group marking unit.

4. A method for drawing an image on a thermal medium, the method comprising:

grouping continuous strokes forming the image of a desired character to be drawn to generate one or more stroke groups of the continuous strokes, each stroke within each stroke group having at least one endpoint in common with at least one other stroke in the respective stroke group;

detecting a first overlapped part between a first combination of the strokes associated with the same stroke group to remove the first overlapped part in an arranged order of the strokes within the same stroke group; and detecting a second overlapped part between a second combination of the strokes associated with plural of the stroke groups to remove the second overlapped part from the stroke groups.

5. The method according to claim 4, wherein the stroke group associated with the first combination of the strokes is a first stroke group, the second combinatior of strokes forms a second stroke group, the detecting the first overlapped part includes removing the first overlapped part in the arranged order of the strokes within the first stroke group, and the detecting the second overlapped part includes removing the second overlapped part between the first and second stroke groups.

6. The method according claim 4, further comprising marking a stroke group as liable to dissipation based on the first overlapped part of the strokes within the stroke group removed by the detecting the first overlapped part, wherein the detecting the second overlapped part includes determining which strokes of the strokes associated with plural stroke groups are to be modified based on which of the plural stroke groups were marked as liable to dissipation by the marking.

7. A computer-readable recording medium storing a drawing control program for drawing an image on a thermal medium, which, when processed by a processor, causes a drawing control unit of a drawing apparatus to execute a set of instructions of the drawing control program, the set of instructions comprising:

grouping continuous strokes forming the image of a desired character to be drawn to generate one or more stroke groups of the continuous strokes, each stroke within each stroke group having at least one endpoint in common with at least one other stroke in the respective stroke group;

detecting a first overlapped part between a first combination of the strokes associated with the same stroke group to remove the first overlapped part in an arranged order of the strokes within the same stroke group; and detecting a second overlapped part between a second combination of the strokes associated with plural of the stroke groups to remove the second overlapped part from the stroke groups.

8. The computer-readable recording medium according to claim 7, wherein the stroke group associated with the first combination of the strokes is a first stroke group, the second combination of strokes forms a second stroke group, the detecting the first overlapped part includes removing the first overlapped part in the arranged order of the strokes within the first stroke group, and the detecting the second overlapped part includes removing the second overlapped part between the first and second stroke groups.

9. The computer-readable recording medium according claim 7, further comprising marking a stroke group as liable to dissipation based on the first overlapped part of the strokes within the stroke group removed by the detecting the first overlapped part, wherein the detecting the second overlapped part includes determining which strokes of the strokes associated with plural stroke groups are to be modified based on which of the plural stroke groups were marked as liable to dissipation by the marking.

* * * * *